US007213283B2

(12) United States Patent
Rivera

(10) Patent No.: US 7,213,283 B2
(45) **Date of Patent: *May 8, 2007**

(54) FOLDING MULTIPURPOSE POCKET TOOL WITH FLOATING SPRINGS

(75) Inventor: Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/475,682

(22) Filed: Jun. 27, 2006

(65) Prior Publication Data

US 2006/0236465 A1 Oct. 26, 2006

Related U.S. Application Data

(63) Continuation of application No. 11/141,935, filed on May 31, 2005, now Pat. No. 7,146,668, which is a continuation of application No. 10/627,830, filed on Jul. 24, 2003, now Pat. No. 6,957,466, which is a continuation of application No. 10/062,759, filed on Jan. 30, 2002, now Pat. No. 6,622,328, which is a continuation-in-part of application No. 09/703,369, filed on Oct. 31, 2000, now Pat. No. 6,622,327.

(51) Int. Cl.
*B25B 7/22* (2006.01)
*B26B 11/00* (2006.01)

(52) U.S. Cl. ..... 7/128; 7/125; 7/155; 30/152

(58) Field of Classification Search ..... 7/125–129, 7/151, 152, 154–158, 132, 134, 165–168; 81/427.5, 177.4, 177.6, 415, 418, 489, 490; 30/152, 156, 160, 161

See application file for complete search history.

(56) References Cited

U.S. PATENT DOCUMENTS

| | | | |
|---|---|---|---|
| 187,483 | A | 2/1877 | Rightor |
| 345,296 | A | 7/1886 | Friebertshauser |
| 716,623 | A | 12/1902 | Brouillette |
| 1,046,361 | A | 12/1912 | Wulff |

(Continued)

FOREIGN PATENT DOCUMENTS

| | | |
|---|---|---|
| DE | 217059 | 12/1909 |

(Continued)

OTHER PUBLICATIONS

RCE "Magnum" fish gripper, on sale at least as early as 1990, package and photographs.

(Continued)

*Primary Examiner*—David B. Thomas
(74) *Attorney, Agent, or Firm*—Chernoff, Vilhauer, McClung & Stenzel, LLP

(57) ABSTRACT

A folding multipurpose hand tool including folding pliers or scissors and other tool blades and bits. A pair of handles each has a pivot axle at each end. A base of each pliers jaw or scissors blade is mounted on the pivot axle at one end of a handle, allowing the handles to fold around the jaws to blades to a compact folded configuration of the tool. Each handle has frame side members with attached flanges. Elongate springs lie between the handle frame side members and fit around the flanges, rather than being riveted to the handle frame side members. The springs press against the base of each pliers jaw or other tool blade, to keep each in a folded position or support it in a deployed position. One end of a spring may be hooked around a spring retainer at one end of the handle. The pivot axles interconnect the handle frame side members and the jaws, blades, or tool bits.

37 Claims, 23 Drawing Sheets

U.S. PATENT DOCUMENTS

| | | | |
|---|---|---|---|
| 1,179,111 | A | 4/1916 | Knowlton |
| 1,561,262 | A | 11/1925 | Martin |
| 1,644,705 | A | 10/1927 | Belcher |
| 1,810,031 | A | 6/1931 | Schrade |
| 2,197,136 | A | 4/1940 | Share et al. |
| 2,250,290 | A | 7/1941 | Berg |
| 2,503,380 | A | 4/1950 | Derby |
| 2,597,540 | A | 5/1952 | Smith |
| 2,718,695 | A | 9/1955 | Elsener |
| 2,980,996 | A | 4/1961 | Beran |
| 3,832,775 | A | 9/1974 | Stahel, II et al. |
| 4,238,862 | A | 12/1980 | Leatherman |
| 4,302,877 | A | 12/1981 | Hart et al. |
| 4,347,665 | A | 9/1982 | Glesser |
| 4,512,051 | A | 4/1985 | Magan |
| 4,570,341 | A | 2/1986 | Konneker |
| 4,669,188 | A | 6/1987 | Evrell |
| 4,744,272 | A | 5/1988 | Leatherman |
| 4,759,645 | A | 7/1988 | Kuo |
| 4,805,250 | A | 2/1989 | Dugas |
| 4,805,303 | A | 2/1989 | Gibbs |
| 4,837,932 | A | 6/1989 | Elsener |
| 4,882,841 | A | 11/1989 | Marolis |
| 4,888,869 | A | 12/1989 | Leatherman |
| 5,029,354 | A | 7/1991 | Boyd et al. |
| 5,125,157 | A | 6/1992 | Howard |
| 5,142,721 | A | 9/1992 | Sessions et al. |
| 5,212,844 | A | 5/1993 | Sessions et al. |
| 5,267,366 | A | 12/1993 | Frazer |
| 5,358,297 | A | 10/1994 | Coleman |
| 5,400,451 | A | 3/1995 | Furukawa |
| 5,402,575 | A | 4/1995 | Maxcy |
| 5,511,310 | A | 4/1996 | Sessions et al. |
| 5,537,750 | A | 7/1996 | Seber et al. |
| 5,546,662 | A | 8/1996 | Seber et al. |
| 5,553,340 | A | 9/1996 | Brown |
| 5,564,318 | A | 10/1996 | Pail |
| 5,594,966 | A | 1/1997 | Goldman |
| 5,653,525 | A | 8/1997 | Park |
| 5,664,274 | A | 9/1997 | Collins |
| 5,697,114 | A | 12/1997 | McIntosh et al. |
| 5,711,194 | A | 1/1998 | Anderson et al. |
| 5,727,319 | A | 3/1998 | Myerchin et al. |
| 5,745,997 | A | 5/1998 | Berg et al. |
| 5,765,247 | A | 6/1998 | Seber et al. |
| 5,809,599 | A | 9/1998 | Frazer |
| 5,809,600 | A | 9/1998 | Cachot |
| 5,857,268 | A | 1/1999 | Park |
| 5,927,164 | A | 7/1999 | Anderson et al. |
| 5,978,993 | A | 11/1999 | Rivera |
| 5,979,059 | A | 11/1999 | Leatherman et al. |
| 5,979,959 | A | 11/1999 | Rivera |
| 6,006,384 | A | 12/1999 | Toal |
| 6,006,385 | A | 12/1999 | Kershaw et al. |
| 6,014,786 | A | 1/2000 | Cachot |
| 6,014,787 | A | 1/2000 | Rivera |
| 6,038,723 | A | 3/2000 | Nabors et al. |
| 6,038,735 | A | 3/2000 | Chang |
| 6,047,619 | A | 4/2000 | Anderson et al. |
| 6,082,232 | A | 7/2000 | Anderson et al. |
| 6,085,620 | A | 7/2000 | Anderson et al. |
| 6,092,444 | A | 7/2000 | Hsiao |
| 6,098,225 | A | 8/2000 | McIntosh et al. |
| 6,101,654 | A | 8/2000 | Cachot |
| 6,105,189 | A | 8/2000 | Nabors et al. |
| 6,119,561 | A | 9/2000 | Anderson et al. |
| 6,128,805 | A | 10/2000 | Rivera |
| 6,131,222 | A | 10/2000 | Anderson et al. |
| 6,145,851 | A | 11/2000 | Heber |
| 6,182,541 | B1 | 2/2001 | Anderson et al. |
| 6,216,301 | B1 | 4/2001 | Rivera |
| 6,243,901 | B1 | 6/2001 | Elsener et al. |
| 6,257,106 | B1 | 7/2001 | Anderson et al. |
| 6,273,582 | B1 | 8/2001 | Taggart et al. |
| 6,279,186 | B1 | 8/2001 | Ge et al. |
| 6,286,397 | B1 | 9/2001 | Taggart et al. |
| 6,289,768 | B1 | 9/2001 | Anderson et al. |
| 6,293,018 | B1 | 9/2001 | Rivera |
| 6,298,756 | B1 | 10/2001 | Anderson et al. |
| 6,314,600 | B1 | 11/2001 | Cachot |
| 6,318,218 | B1 | 11/2001 | Anderson et al. |
| 6,341,423 | B1 | 1/2002 | Taggart et al. |
| 6,352,010 | B1 | 3/2002 | Giarritta et al. |
| 6,389,625 | B1 | 5/2002 | Rivera |
| 6,408,522 | B2 | 6/2002 | Rivera |
| 6,413,173 | B1 | 7/2002 | Müller et al. |
| 6,443,768 | B1 | 9/2002 | Dirkers et al. |
| 6,588,040 | B2 | 7/2003 | Rivera |
| 6,622,327 | B1 | 9/2003 | Rivera |
| 6,622,328 | B2 | 9/2003 | Rivera |
| 6,957,466 | B2 * | 10/2005 | Rivera ..... 7/128 |
| 2001/0014986 | A1 | 8/2001 | Harrison |
| 2003/0140740 | A1 | 7/2003 | Rivera |
| 2004/0019973 | A1 | 2/2004 | Rivera |

FOREIGN PATENT DOCUMENTS

| | | |
|---|---|---|
| DE | 270186 | 12/1926 |
| DE | 2364906 | 7/1975 |
| EP | 0676261 | 10/1995 |
| EP | 0771622 | 5/1997 |
| EP | 0783937 | 7/1997 |
| EP | 1116557 | 7/2001 |
| EP | 1023971 | 3/2002 |
| FR | 8916842 | 12/1989 |
| FR | 2655635 | 6/1991 |
| FR | 9703800 | 3/1997 |
| FR | 2760955 | 9/1998 |
| GB | 270186 | 5/1927 |
| GB | 947703 | 1/1964 |
| WO | WO 97/19787 | 6/1997 |
| WO | WO 98/18599 | 5/1998 |

OTHER PUBLICATIONS

Folding scissors with chain, on sale at least as early as 1994, photographs.

Fiskars, Inc. "Multi-snip Tool Kit", Aug. 1996.

U.S. Appl. No. 10/066,087, filed Jan. 30, 2002, Rivera, Benjamin C.

* cited by examiner

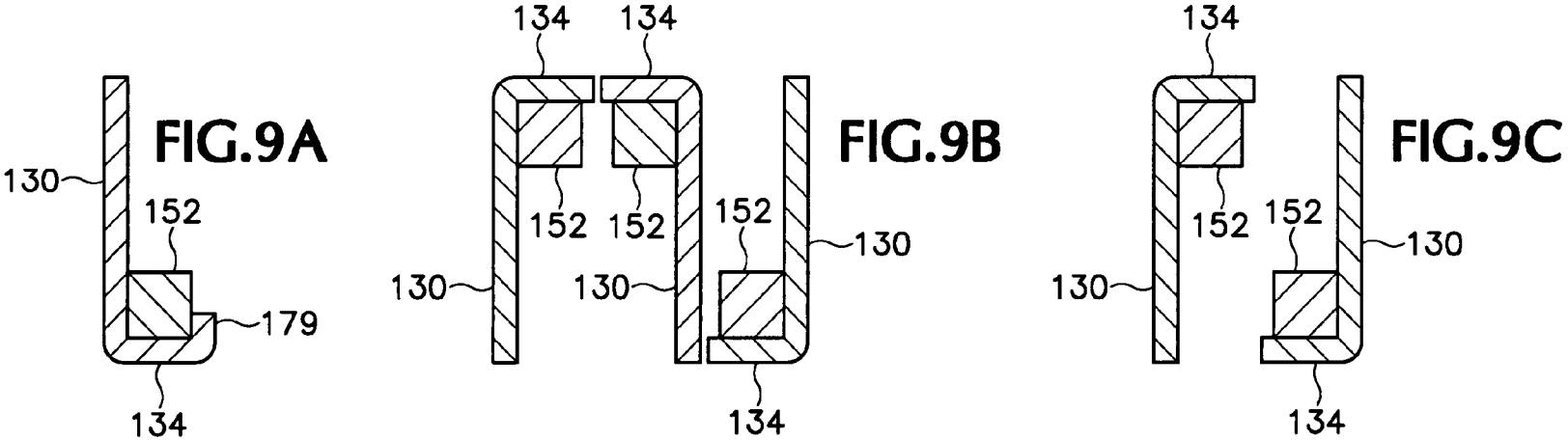
FIG.9A
FIG.9B
FIG.9C
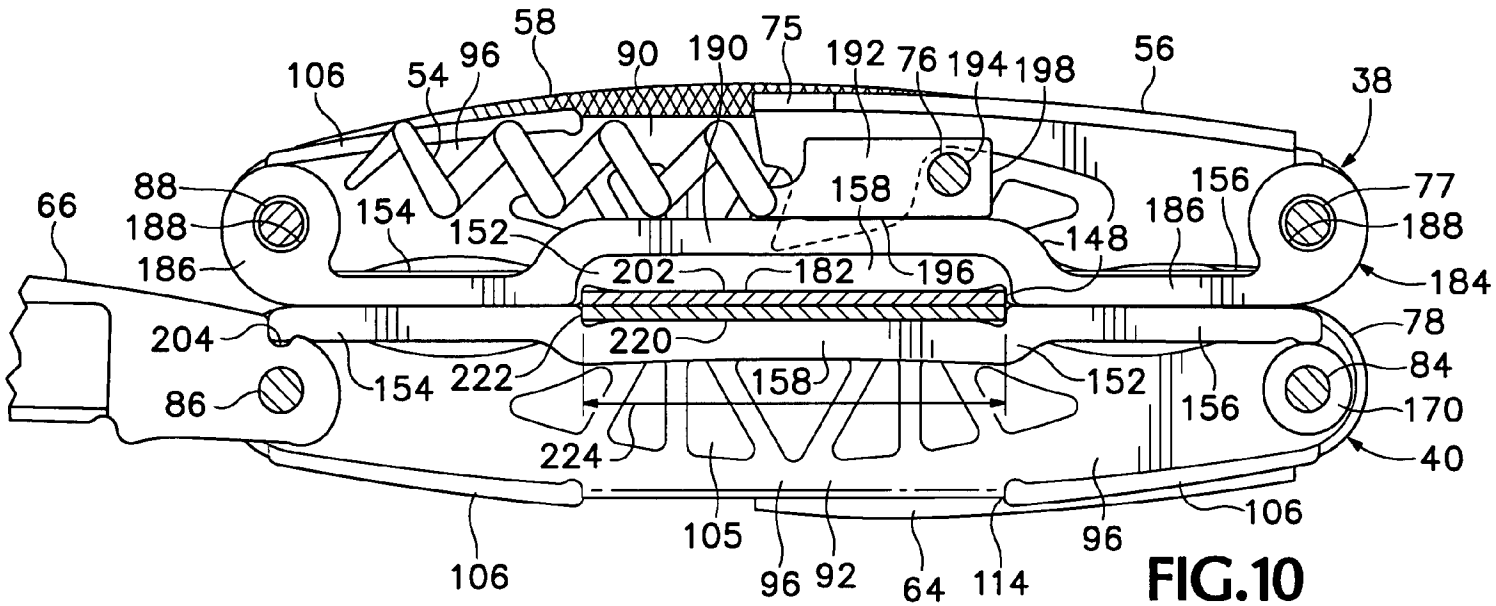
FIG.10

FOLDING MULTIPURPOSE POCKET TOOL WITH FLOATING SPRINGS

CROSS-REFERENCE TO RELATED APPLICATIONS

This application is a continuation of U.S. patent application Ser. No. 11/141,935, filed May 31, 2005, now U.S. Pat. No. 7,146,668 which is a continuation of U.S. patent application Ser. No. 10/627,830, filed Jul. 24, 2003, now U.S. Pat. No. 6,957,466 which is a continuation of U.S. patent application Ser. No. 10/062,759, filed Jan. 30, 2002, now U.S. Pat. No. 6,622,328 which is a continuation-in-part of U.S. patent application Ser. No. 09/703,369, filed Oct. 31, 2000, now U.S. Pat. No. 6,622,327.

BACKGROUND OF THE INVENTION

The present invention relates to folding multipurpose tools, and in particular to such a tool which may include a pair of pliers and several different tool bits and blades and that can be folded small enough to be carried comfortably in one's pocket.

Folding knives and the like including blades or tool bits available to be unfolded from both ends of a handle have typically included springs in the back of the handle to hold each blade in its folded position or in its deployed position by pressing on the base of the blade. Not only do such springs press against the base of a blade to hold it open or closed, but they also bear a considerable axially-directed load when a deployed blade or tool bit is used. For example, a knife acts as a lever tending to rotate about its pivot pin and a surface on the rear of the knife blade presses against an end of the spring.

Where a single spring is required to act upon tool members on both ends of a handle the spring has typically been held in place with respect to other parts of the handle by a rivet located centrally along the length of the handle.

The forces generated by use of a knife blade typically are fairly small, and small-diameter blade pivot pins and spring-holding fasteners are sufficient. Where pliers are supported by a pair of folding handles, however, the loads to be carried axially within a spring are potentially significantly greater. A rivet or other fastener holding or supporting a spring in a handle of such a tool would need to be larger, and a spring would need to have a correspondingly large area to receive such a fastener. For a tool including folding pliers and intended to be small enough to be carried in one's pocket, that type of construction would result in an undesirably large tool.

Folding multipurpose tools of many types have been available in recent years, but most such tools including pliers large enough to be fairly strong are rather bulky, heavy, and industrial in appearance. Manufacture of more compact tools, using a single spring for multiple blades, has required careful adjustment during assembly in order to have pliers jaws and other blades and tool bits fold and extend crisply and without undesirable amounts of free play or friction. Use of an individual spring for each blade or bit has resulted in loss of compactness, making a tool requiring a pair of handles undesirably bulky. Smaller tools including folding pliers have been comparatively weak and thus of limited utility.

In some previously available multipurpose tools including folding pliers, various tool blades are available only after having to separate a pair of handles to reach those tool blades.

What is desired, then, is a multipurpose folding tool having a pleasant appearance, which has adequate strength, which can be folded or opened easily yet which feels secure, which can be manufactured satisfactorily without extremely close tolerances, and yet which is light enough and compact enough when in a folded configuration to be carried comfortably in one's pocket.

SUMMARY OF THE INVENTION

The present invention provides answers to the aforementioned needs for compactness, strength, and versatility in a multipurpose folding tool by providing such a tool in which a handle frame side member includes an integral laterally-extending flange, and in which a spring has a central portion supported by and retained axially by the flange, while an outer end portion of the spring is free to flex and is biased to bear upon the base portions of a blade or a tool member moveable about a pivot axle between a folded, or stowed, position and an extended, deployed position.

The present invention thus provides a folding multipurpose tool including, in combination, a frame side member having a pair of opposite ends and an integral flange member located between the opposite ends and extending laterally from the frame side member, a pivot axle extending through the frame side member at a respective one of its opposite ends, a first tool member having a base portion mounted on the pivot axle for pivoting movement between a deployed position and a folded position with respect to the frame side member, a spring retainer located at the other one of the opposite ends of the frame side member, and an elongate spring having a pair of opposite end portions and a central portion, the central portion being engaged with and supported by the flange, a first one of the end portions of the spring resting on the base portion of the tool member, and the other one of the opposite end portions of the spring extending partially around and resting on the spring retainer.

In one preferred embodiment of the invention, the flange extending from the frame side member has an inner side and an end face, and a central portion of the spring includes a back side supported by the inner side of the flange and an abutment shoulder located adjacent and facing toward the end face of the flange, so that the end face of the flange and the abutment shoulders of the spring cooperatively restrict longitudinal movement of the spring in one direction with respect to the flange.

In one preferred embodiment of the invention, two frame side members are interconnected by the flange and thus form a channel, and the elongate spring is located between the frame side members, in the channel.

In another preferred embodiment of the present invention, such a channel faces openly in a first direction as part of a tool handle, and an additional integral flange extends laterally away from one of the interconnected frame side members. A handle plate or scale may be provided along the additional flange to form a side slot facing in the opposite direction from the channel, and a spring extending longitudinally from the laterally outwardly extending flange can be engaged with a base of a tool member mounted on the pivot axle on the outer side of the frame side member so that the tool members in the channel open in one direction with respect to the handle while the tool member located in such a side slot opens in an opposite direction with respect to the handle.

In one preferred embodiment of the invention, a separate tool member is located on each of a pair of pivot axles alongside a frame side member, and base portions of the tool members engage respective springs on the opposite ends of the laterally outwardly extending flange.

In another preferred embodiment of the present invention, such a channel faces openly in a first direction as part of a tool handle, and an additional frame side member with an integral laterally extending flange is also carried on the pivot axles, with the flange directed toward one of the frame side members interconnected by a flange. The additional frame side member is oriented to form a slot or channel facing in the opposite direction, and a spring is engaged with the flange on that additional frame side member. A base of a tool member is mounted on one of the pivot axles alongside the additional frame side member so that the tool members in the channel open in one direction with respect to the handle while the tool member located alongside the additional frame side member opens in an opposite direction with respect to the handle.

In one preferred embodiment of the invention, a separate tool member is located on each of the pivot axles alongside a frame side member, and base portions of the tool members engage each of the opposite ends of the spring.

In another preferred embodiment of the present invention, each of a pair of handles is connected pivotally to the base of a respective one of a pair of pivotally interconnected crossed tool members and at least one of the handles includes a frame side member with a laterally extending flange located between opposite ends of the frame side member, a pair of pivot axles, each extending through the frame side member at a respective one of the opposite ends, a base portion of one of the crossed tool members being mounted on one of the pivot axles for movement about that pivot axle between a deployed position and a folded position with respect to the frame side member, a spacer member or a base of another tool member being located on the other one of the pivot axles, and the handle also includes a beam spring having a pair of opposite end portions and a central portion, the central portion being engaged with the flange, a first one of the end portions of the spring being engaged with the base of the respective crossed tool member, and the other of the end portions being engaged with the spacer or base of a tool member located on the other one of the pivot axles.

In one embodiment of the invention, the crossed tool members are a pair of pliers jaws.

Another aspect of the present invention is the provision of a folding tool including an elongate spring with a pair of opposite ends each mounted on a respective one of a pair of pivot shafts associated with a frame side member, and wherein a surface of that spring presses elastically against a surface of a base of a tool bit attached to the frame side member by a pivot joint located generally between the pivot axles to retain the tool bit in a desired position with respect to the frame side member.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

FIG. 9A is a simplified sectional view of an alternative form of a frame side member and a spring of the tool shown in FIG. 9, taken on line 9A—9A.

FIG. 9B is a view taken in the same direction as FIG. 9A showing a pair of frame side members and springs in an alternative embodiment of the invention.

FIG. 9C is a view similar to FIGS. 9A and 9B showing another alternative embodiment of the invention.

FIG. 10 is a partially cutaway sectional view of the folded tool shown in FIGS. 2–6, with one knife blade deployed, taken along line 10—10 of FIG. 6.

DETAILED DESCRIPTION OF PREFERRED EMBODIMENTS

Figure 1:
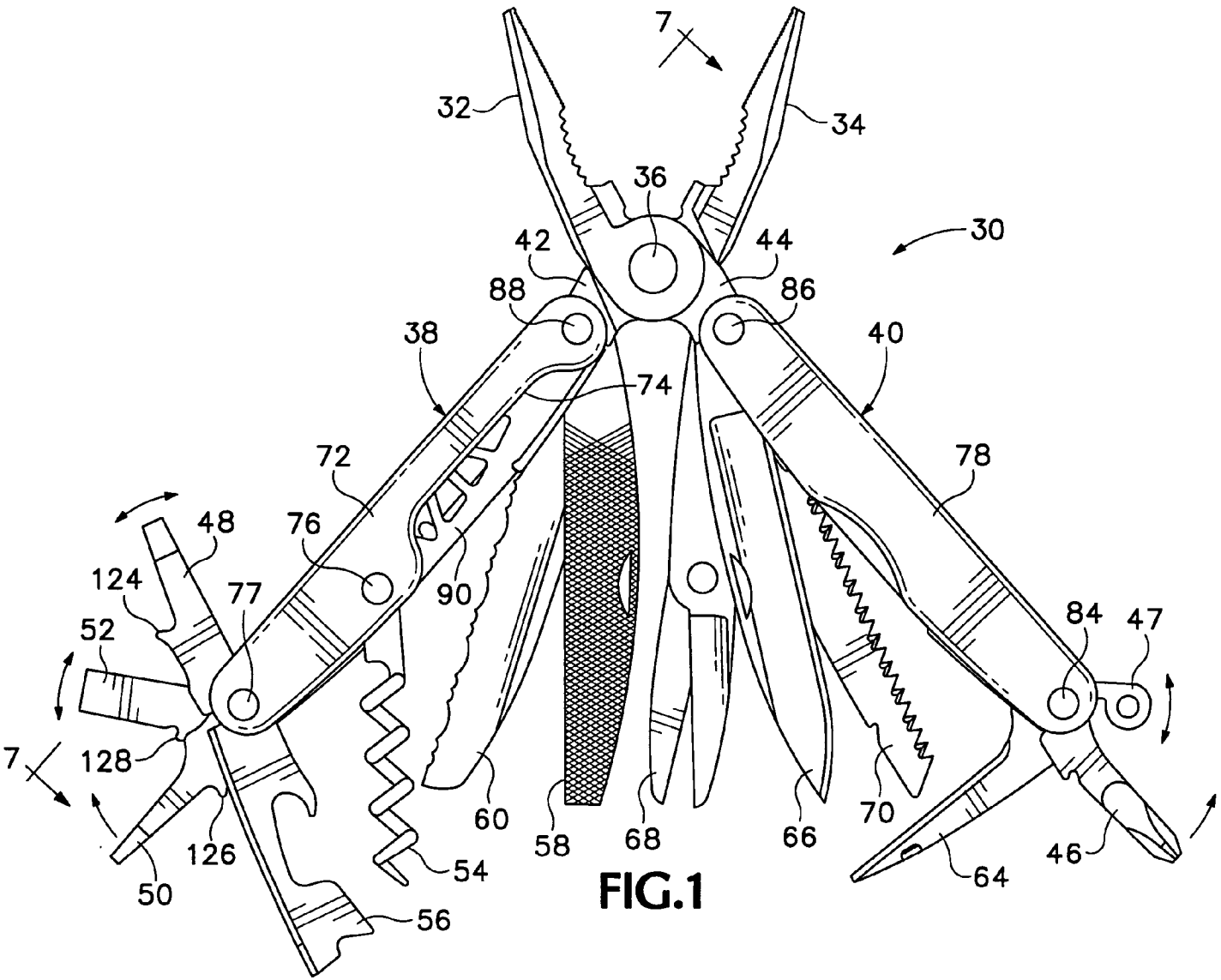
FIG. 1 is a side view of a folding multipurpose pocket tool that is a preferred embodiment of the present invention, showing a pair of pliers in a deployed configuration and showing several other tool bits and blades in partially folded positions with respect to the handles of the folding tool.

Referring now to the drawings which form a part of the disclosure herein, a folding multipurpose tool 30 embodying the present invention is shown in FIG. 1. The folding tool 30 includes a pair of pliers including jaws 32 and 34 that cross each other and are interconnected by a pliers pivot joint 36, preferably secured by a rivet. While the pliers jaws 32 and 34 are of the long nose type and include gripping portions and wire cutter portions, it will be understood that other types of pliers jaws might also be included in such a tool instead, as might metal snip jaws or the like, within the limitations of available space. A pair of handles 38, 40 are attached, respectively, to the base portions 42, 44 of the pliers jaws 34, 32. As will be explained in greater detail subsequently, the pliers jaws 32 and 34 can be moved into stowed or folded positions with respect to the handles 38 and 40, and the folding tool 30 can be placed into a folded configuration shown in FIGS. 2, 3, and 4.

The folding tool 30 also includes several other tool members which can each be folded into a respective stowed or folded position within a respective one of the handles 38, 40, or unfolded into a deployed position. Because of their respective locations within the handles 38 and 40, some of the additional tool members shown in FIG. 1 can be folded or unfolded only when the pliers jaws 32 and 34 are at least partially removed from their stowed positions. That is, the Phillips® screwdriver 46 and the lanyard link 47, associated with the handle 40, and the medium screwdriver blade 48, the narrow screwdriver blade 50, and the wide screwdriver blade 52, associated with the handle 38, cannot be deployed from nor folded into their stowed positions when the pliers jaws 32 and 34 are in their fully folded positions and the handles 38 and 40 are in the position shown in FIGS. 2, 3 and 4, because those tool members all move into and out of stowage positions located on the interior side of the respective one of the handles 38 and 40, where the pliers jaws 32 and 34 are located when the folding tool 30 is in the folded configuration shown in FIGS. 2, 3 and 4.

Figure 2:
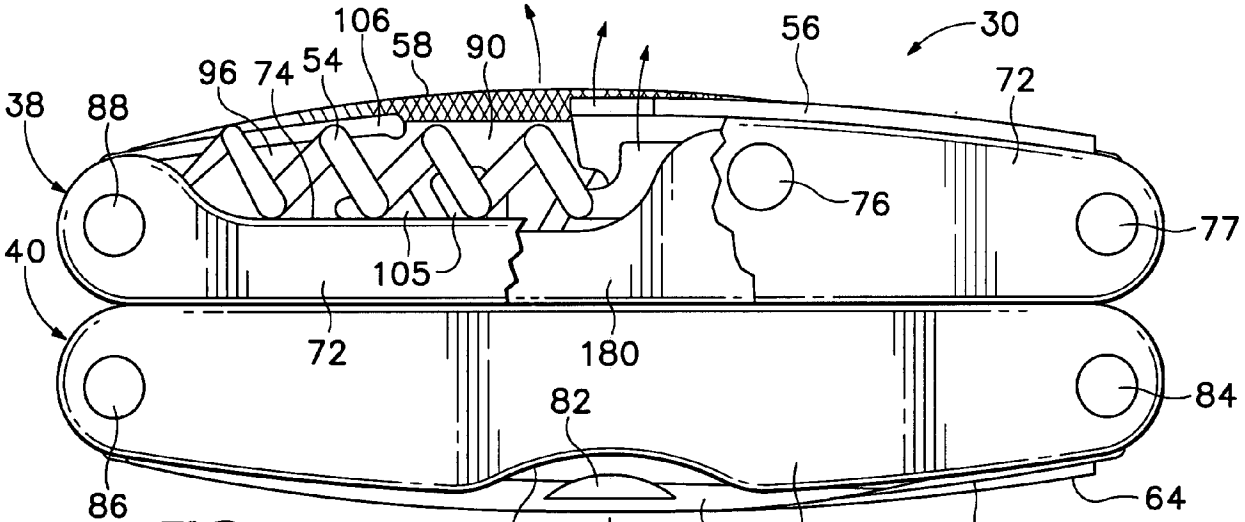
FIG. 2 is a side elevational view of the folding tool shown in FIG. 1, taken from a first side thereof.
Figure 4:
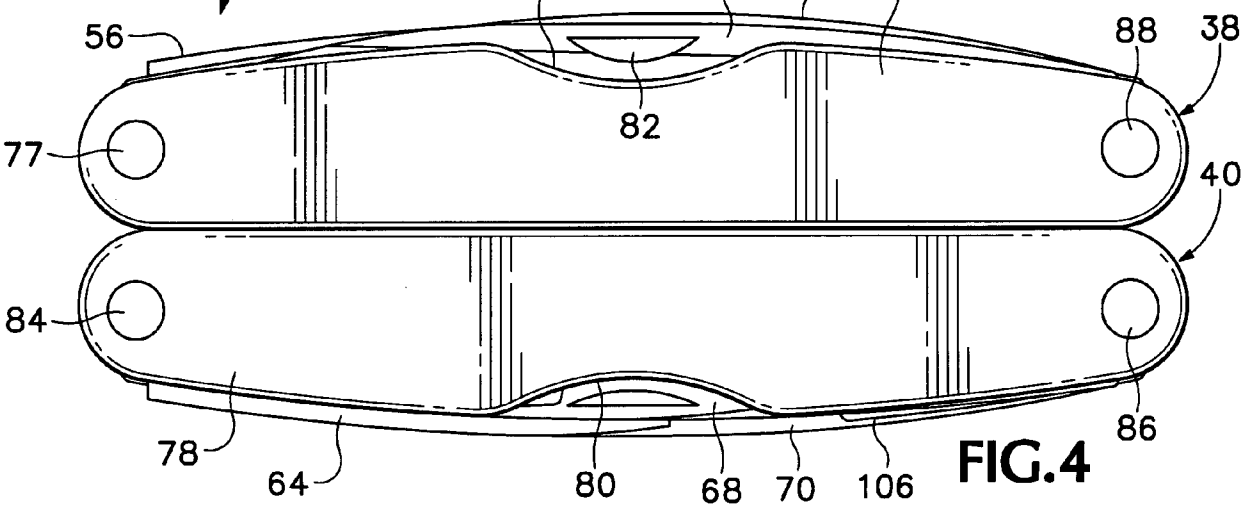
FIG. 4 is a side elevational view of the other side of the folding tool shown in FIGS. 1 and 2.
Figure 3:
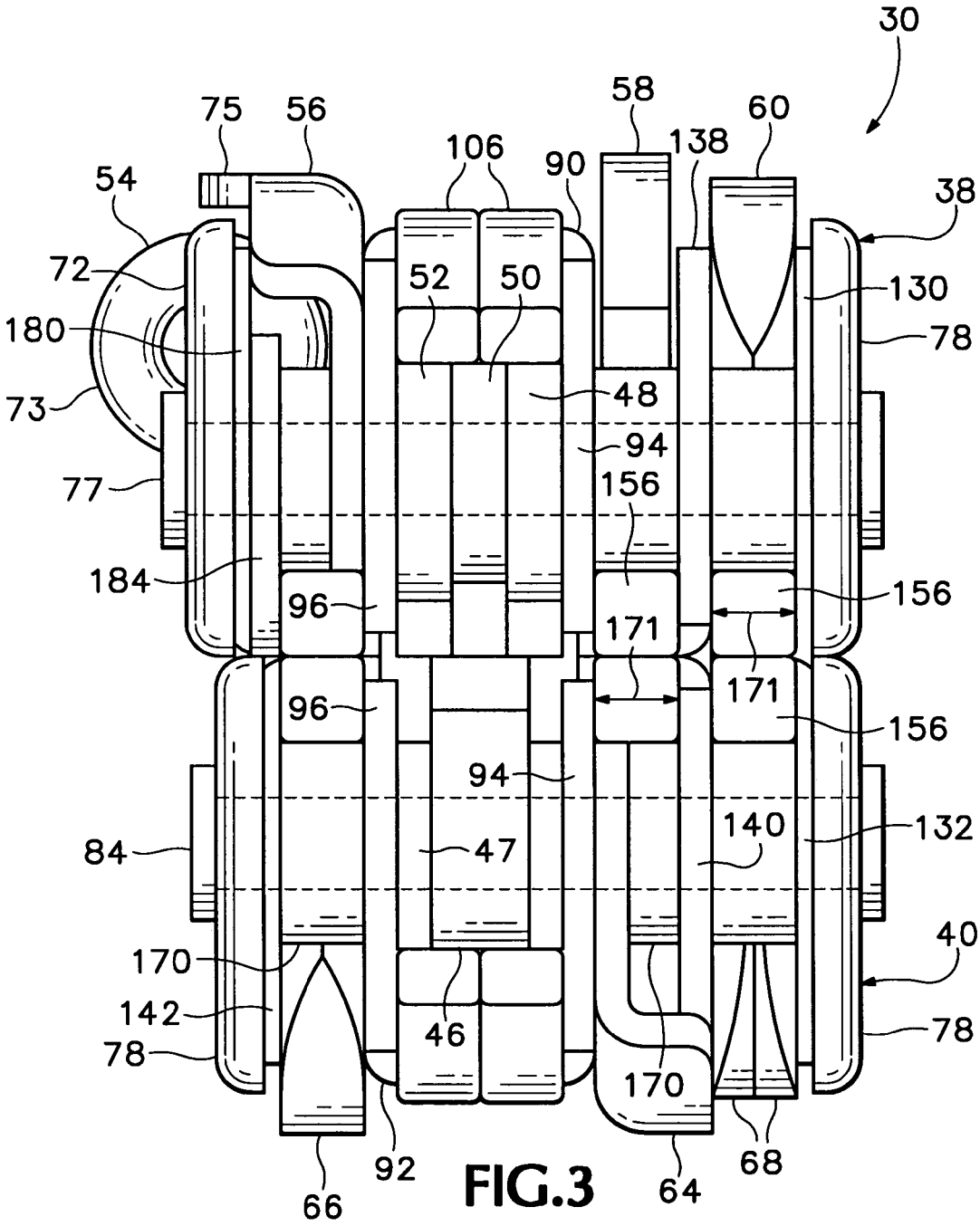
FIG. 3 is an elevational view of the folding tool shown in FIGS. 1 and 2, taken from the right end of FIG. 2.
Figure 5:
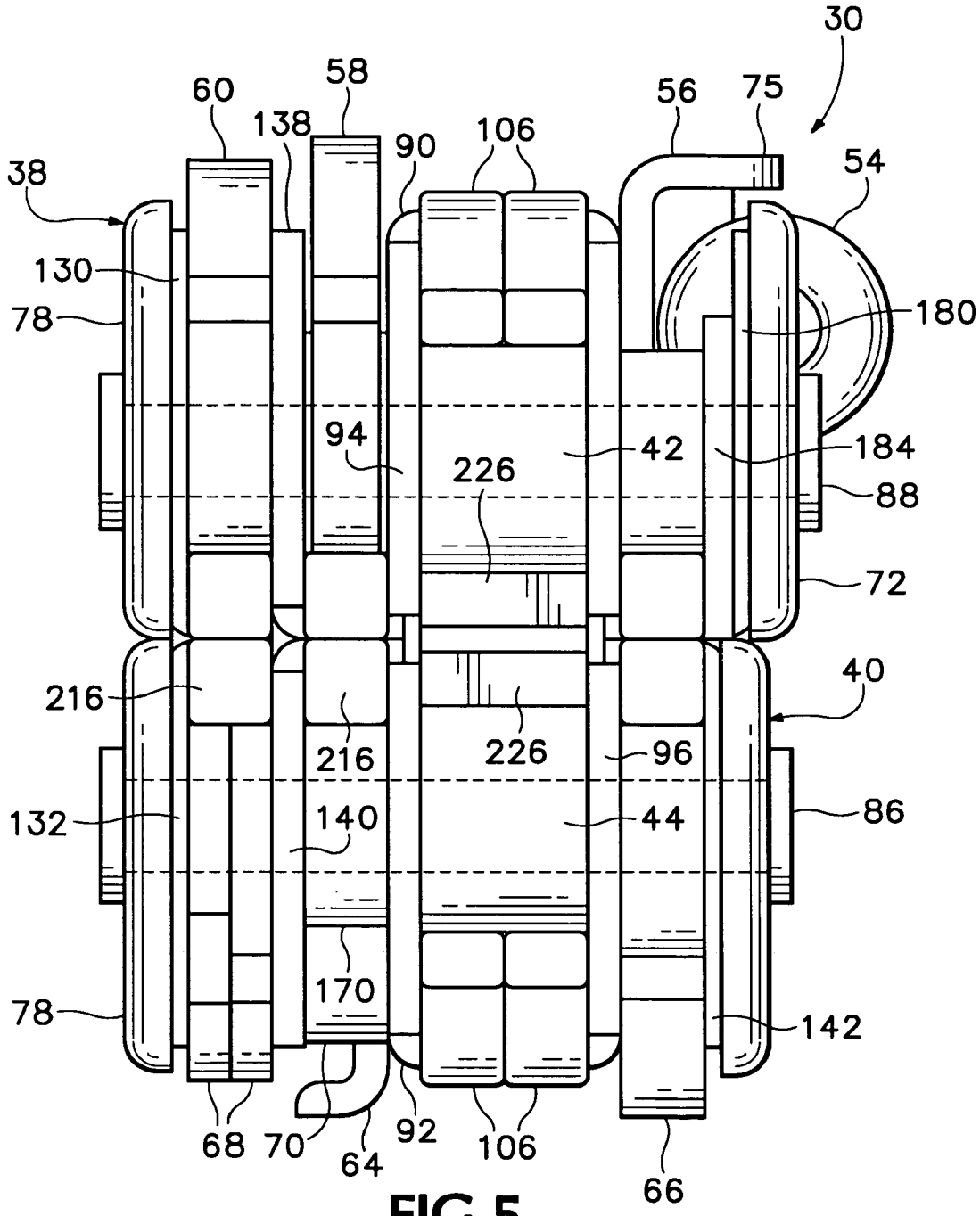
FIG. 5 is an elevational view of the folding tool shown in FIGS. 1–4, taken from the right end of FIG. 4.
Figure 6:
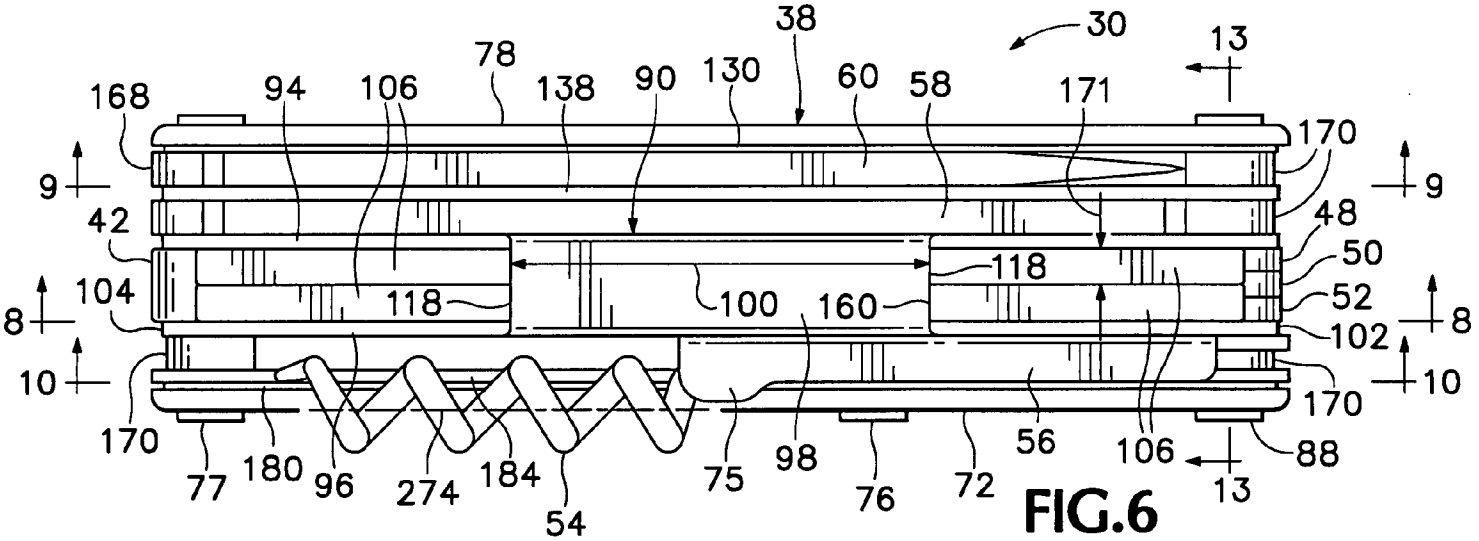
FIG. 6 is a top view of the folded tool shown in FIGS. 2, 3 and 4.

Other tool members or blades are arranged to move into respective stowage positions on the opposite, or exterior, sides of the handles 38 and 40, and those tools thus are available to be opened to their respective deployed positions when the folding tool 30 is in the folded configuration shown in FIGS. 2, 3 and 4. Thus, the corkscrew 54, the combined bottle opener, can opener, and corkscrew brace 56, the file 58, and the serrated edge knife blade 60 are all available to be opened from their respective positions in the handle 38 when the folding tool 30 is in the folded configuration shown in FIGS. 2, 3 and 4.

Similarly, the awl 64, the drop point knife blade 66, the scissors 68, and the saw 70 are all available to be deployed when the folding tool 30 is in the folded configuration.

It will be understood that the arrangement of tool members and blades shown included in the folding tool 30 is but one of numerous possibilities, and fewer or different tool members and blades might be included in a folding tool such as the tool 30 without departing from the spirit of the present invention.

Referring in particular to FIG. 2, it will be seen that on a first side of the folding tool 30 in its folded configuration, the combination can opener and corkscrew brace 56 and the corkscrew 54 are available to be opened from the handle 38, where a handle scale 72 has a shape leaving a large access opening 74 where the corkscrew 54 is located. The scale 72 may be of a desired decorative material such as a suitable plastic, wood, or metal, such as aluminum, which may be anodized or otherwise decorated. The scale 72 has rounded margins which cover the edges of the frame side member 180 to add comfort.

As may be seen in FIG. 3, a portion 73 of the corkscrew 54 protrudes laterally outward somewhat beyond the handle scale 72 at the location of the access opening 74, although its tip is safely located within the overall shape of the handle 38. The corkscrew 54 is attached to the handle 38 at a pivot joint 76 located near mid-length of the handle 38, as will be explained in greater detail subsequently. The can opener and corkscrew brace 56 is mounted on and can rotate about a pivot axle 77, which may be a rivet, as is shown in FIG. 3. A similar pivot axle 88 is located at the end of the handle 38 opposite the pivot axle 77.

Also readily available on the side of the folding tool 30 seen in FIG. 2, but located in the handle 40, is the drop point knife blade 66. A handle scale 78 includes an indentation 80 located centrally along its outer margin to provide easy access to a nail nick 82 in the knife blade 66.

The drop point knife blade 66 is mounted on a pivot axle 86, located at the opposite end of the handle 40 from the pivot axle 77 in the handle 38. Like the pivot axles 77 and 88, the pivot axle 86 may be a rivet. A similar pivot axle 84 is located at the end of the handle 40 opposite the pivot axle 86.

As seen in FIG. 4, the serrated knife blade 60 is mounted pivotally on the pivot axle 88, and includes a nail nick 82 aligned with the indentation 80 in the handle scale 78 of the handle 38. The scissors 68, mounted on the pivot axle 84, are available similarly in the handle 40, with a nail nick exposed in the indentation 80 in the margin of the scale 78 on that side of the handle 40.

Figure 12:
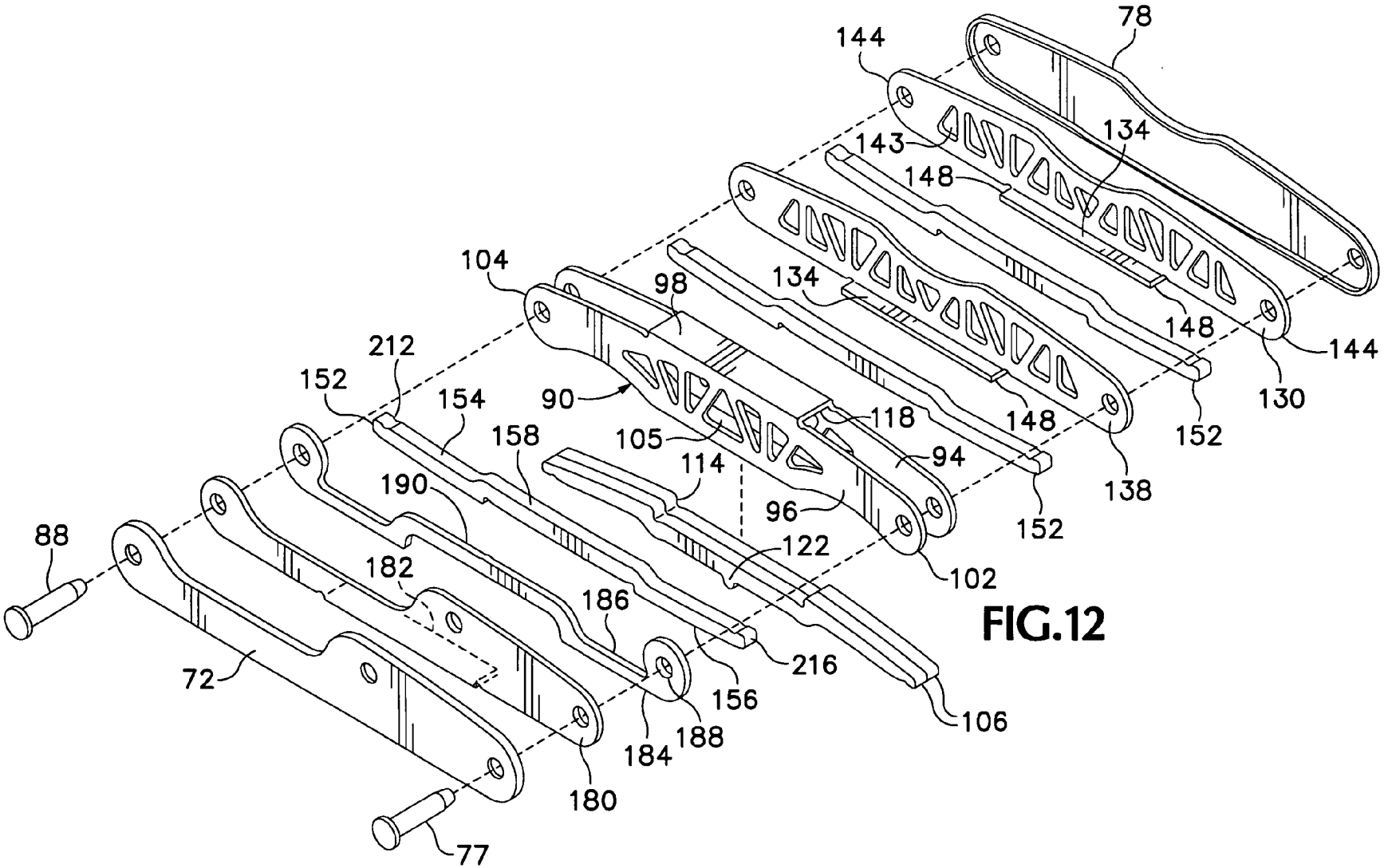
FIG. 12 is an exploded view of components of the handle shown uppermost in FIG. 2, but without the tool members and blades shown in FIGS. 1–10.

Referring also to FIGS. 5, 6, 7 and 8, the pliers jaws 32 and 34 are housed in internal frame members 90 and 92, each including a pair of frame side members 94 and 96 interconnected by a centrally located flange portion 98, as may be seen clearly in FIG. 12 where the frame member 90 is shown separately. Each internal frame member 90, 92 thus includes a short channel portion facing openly inward toward the opposite one of the handles 38 and 40 when the folding tool 30 is in the folded configuration shown in FIGS. 2, 3, and 4. The flange portion 98 has a length 100 that is considerably shorter than the length between the opposite ends 102 and 104 of either frame side member 94 or 96.

The frame side members 94 and 96 are preferably reduced in weight by provision of lightening holes 105 in each frame side member.

A pair of springs 106 are located side by side between the frame side members 94 and 96 of each internal frame member 90 and 92. Each of the springs 106 has a pair of respective end portions 108 and 110 and a central portion 112. The central portion 112 is offset from the end portions 108 and 110 so that an abutment shoulder 114 is formed at each end of the central portion 112. Each abutment shoulder 114 faces toward the other, and a back side 116 of the central portion 112 faces toward the flange 100. The springs 106 are located so that each abutment shoulder 114 confronts a respective one of a pair of opposite end faces 118 of the flange portion 100, and the back side 116 of the central portion of each spring 106 rests against an inner side 120 of the flange 98.

In order to allow the springs 106 to flex as required for the pliers jaws 32 and 34 to move between their respective deployed configuration shown in FIG. 1 and the folded configuration of the folding tool 30, the distance between the abutment shoulders 114 is slightly greater than the length 100 of the flange 98. This provides a small clearance between the abutment shoulders 114 and the end faces 118 when the spring 106 is relaxed, with the clearance preferably being on the order of 0.1–0.2 millimeter.

A length 121 of each of the springs 106 is at least about equal to and preferably slightly greater than the center-to-center spacing between the pivot axles 77 and 88, or 84 and 86. The shape of the springs 106 is such that each is always at least slightly flexed, causing an elastic force biasing each end portion 108 against the respective base portion 42 or 44 of the pliers jaws 32 and 34. The back side 116 is biased against the respective inner side 120 of the flange 98, and the end portion 110 biased against a respective base portion of at least one tool member such as one of the screwdriver blades 46, 48, 50 or 52.

Each of the springs 106 includes a centrally located locator portion 122 protruding inwardly toward the interior of the channel portion of the respective internal frame 90 or 92 to limit the extent to which the pliers jaws 32 and 34 can move into the channel portion defined by each internal frame 90 or 92. The locators 122 prevent the pliers jaws 32 and 34 from intruding into the space required by the screwdrivers 46, 48, 50, and 52 within the handles 38 and 40.

Figure 8:
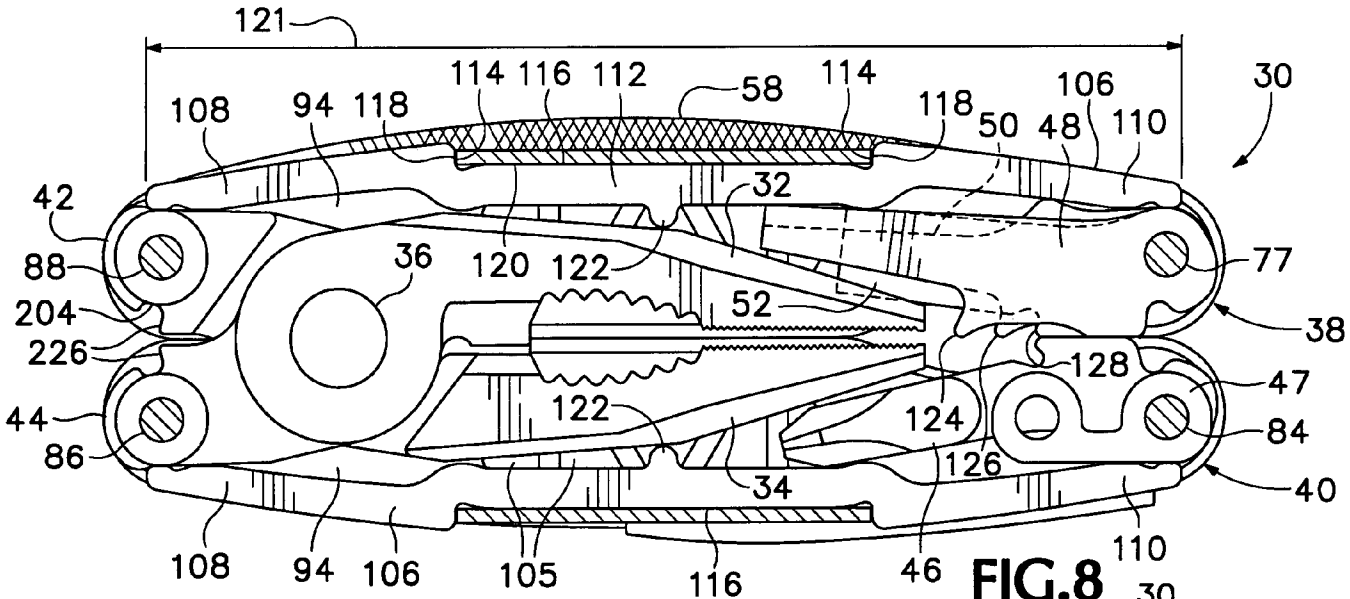
FIG. 8 is a sectional view of the folded tool shown in FIGS. 2–6, taken along line 8—8 in FIG. 6.

When the pliers jaws 32 and 34 are in the folded, or stowed, position shown in FIG. 8, the end portions 108 of the springs 106 act on each base portion 42, 44 with elastic force to urge the pliers jaws 32 and 34 into their folded positions with respect to the handles 38 and 40, thus biasing the tool 30 into its folded configuration.

The pressure of the end portions 108 against the pliers base portions 42 and 44 and of the end portions 110 against the base portions of the screwdriver blades 46, 48, 50, and 52, keeps the central portion 112 of each of the springs 106 securely engaged with the flange 98. The back side 116 of each spring 106 presses against the inner face 120 of the flange portion 98, with the abutment shoulders 114 confronting the opposite end faces 118 of the flange 98, so that the springs 106 are securely retained within the respective internal frame 90 or 92, without having to be pinned or riveted to the handle frame side members 94 or 96 as in conventional folding knife construction.

Because of the stresses likely to be caused by use of the pliers the pivot axles 84 and 88 are of ample thickness, for example 0.125 inch in diameter, and each internal frame 90 and 92 is of strong material, and preferably steel, for example pressed sheet steel 1 millimeter thick.

Both the springs 106 and the internal frames 90 and 92 are preferably symmetrical about a transverse plane of symmetry, so that identical parts can be used as either internal frame 90 or 92 and can be assembled without concern for the direction of the ends 102 and 104 with respect to the end portions 108 and 110 of the springs 106.

Figure 7:
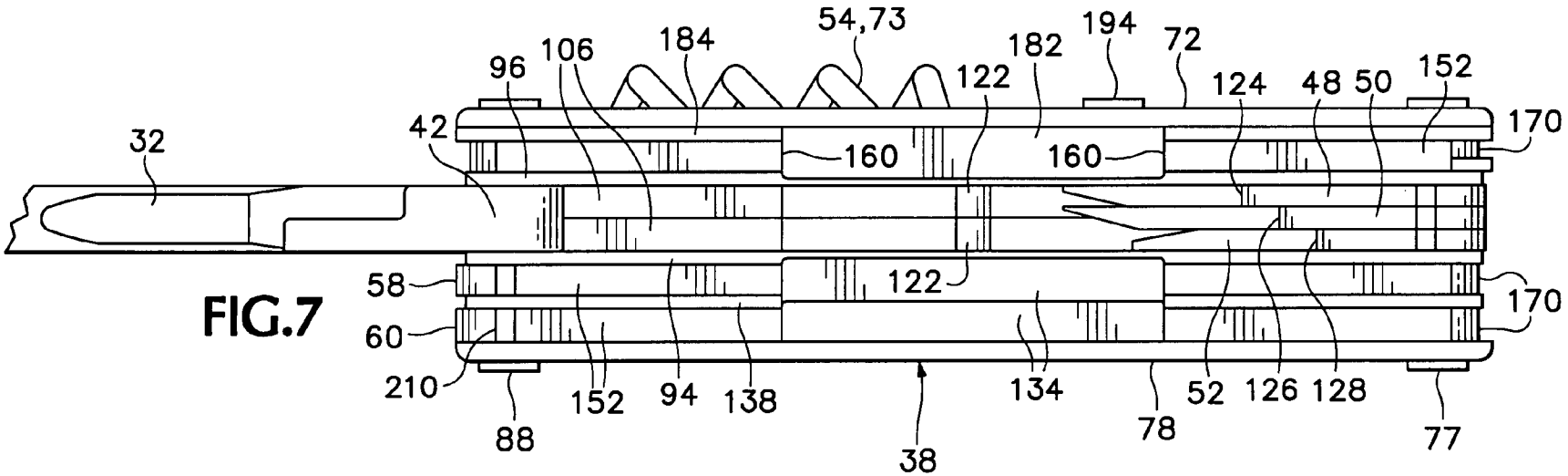
FIG. 7 is a partially cutaway view taken in the direction indicated by the line 7—7 in FIG. 1, showing one handle of the folding tool with the pliers jaws deployed.

As may be seen in FIGS. 7 and FIG. 8, the screwdriver blades 48, 50, and 52 have respective thumb-like projections 124, 126, and 128 to serve as nail catches for unfolding each screwdriver blade from its folded position. The projections 124, 126, and 128 are located at different distances from the pivot axle 77, separated from each other by a distance of preferably at least one or two millimeters so that any of the three screwdriver blades 48, 50, and 52 can easily be opened individually.

Because of the flexed condition of the springs 106, the end portions 110 of the two springs 106 ride on the peripheral surfaces of the base portions of the screwdriver blades 48, 50, and 52, causing friction sufficient to keep the screwdriver blades from falling freely open from their folded positions within the internal frame 90. Similarly, the end portion 110 of the spring 106 in the other internal frame 92 presses against the peripheral surface of the base portion of the screwdriver 46, with sufficient friction to keep the screwdriver blade 46 in its stowed position.

The peripheral surfaces, however, do not provide a camming action to urge the screwdriver blades 46, 48, 50, and 52 into their respective stowed positions. Instead, the base of each such screwdriver blade 46, 48, 50 or 52 may be shaped to act as a cam forcing the respective spring to flex more as the screwdriver approaches the fully folded or stowed position. Friction between the spring and the base of the screwdriver blade holds the screwdriver securely in its folded position, but the friction is partially overcome by the shape followed by the spring, which over a few degrees of movement from the fully folded position tends to urge the screwdriver blade away from the folded position by cam action, but with too little force to completely overcome friction. Accordingly, it is relatively easy to begin to move any of the screwdrivers 46, 48, 50, or 52 from their stowed positions.

Once any of the screwdriver blades moves more than a small angle from its fully stowed position, however, a cam lobe portion of the base portion of each screwdriver urges the end portion 110 of the spring or springs 106 outward, initially increasing friction and later allowing a catch arrangement to engage the fully deployed screwdriver blade, as will be explained in greater detail subsequently.

To provide the folding multipurpose tool 30 various additional capabilities besides the basic pliers jaws and screwdrivers shown in FIG. 8 and described immediately above, various numbers of external frame side members housing additional tool members and blades are located alongside the internal frames 90 and 92.

Figure 9:
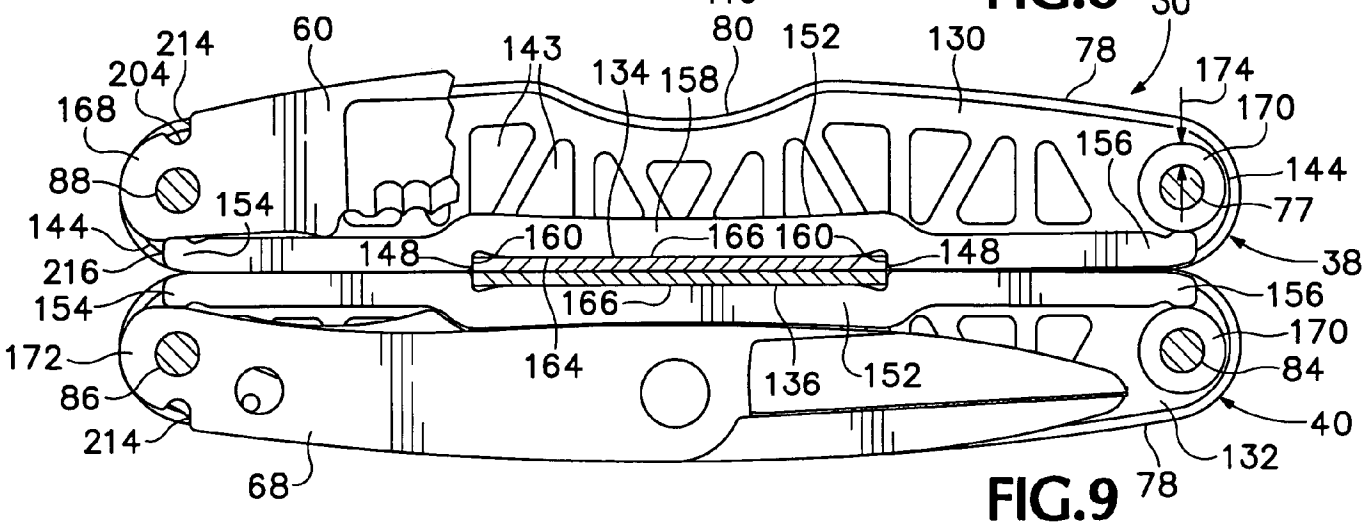
FIG. 9 is a partially cutaway sectional view of the folded tool shown in FIGS. 2–6, taken along line 9—9 in FIG. 6.

As shown in FIG. 9, for example, frame side members 130 and 132 are included as parts of the handles 38 and 40. A flange 134, integral with the frame side member 130, extends laterally inward toward the flange 98 of the internal frame 90 of the handle 38. A similar flange 136, integral with the frame side member 132, extends laterally inward toward the flange 98 forming the channel portion of the internal frame 92 of the handle 40. The flanges 134 and 136 are located on the interior sides of the handles 38 and 40, the sides of the handles 38 and 40 which are located close together when the folding tool 30 is in its folded configuration, as shown in FIG. 9. The frame side members 130 and 132 are identically similar to each other and are preferably symmetrical about a transverse central plane, so that they are interchangeable with each other. Additional similar frame side members 138 and 140 are also located respectively in the handles 38 and 40, between the internal frames 90 and 92 and the frame side members 130 and 132, respectively. Another similar frame side member 142 is included in the handle 40, as may be seen in FIG. 3, alongside the drop point knife blade 66. The respective flange 134, 136, etc. for each of the frame side members 130, 132, 138, 140, and 142, is preferably manufactured along with the respective frame side member 130, etc., by bending a portion of sheet metal blank. The frame side members 130, etc., and their flanges, 134, etc., may be made of an appropriate metal such as aluminum or other material, depending upon the strength required by the particular tool members associated therewith, although sheet steel is preferred, with weight reduced, if desired, by lightening holes 143.

Each frame side member 130, 132 and the like has a pair of opposite ends 144, and the flange 134, 136, etc. is located centrally along the frame side member and has a pair of opposite end faces 148.

An elongate beam spring 152 associated with each frame side member 130, 132, etc., has a pair of opposite end portions 154 and 156 and a central portion 158 which rests on the flange 134, 136, etc., engaging the end faces 148 with respective abutment shoulders 160. A back side 164 of the central portion 158 rests against an inner face 166 of the flange 134, and the spring 152 thus engages the flange 134 the same way that the springs 106 fit around the flange portions 98 of the internal frames 90 and 92, as described above.

The spring 152 shown in FIG. 9 in the handle 38 is held slightly flexed, and thus the outer end portion 154 is elastically biased against a surface of the base portion 168 of the knife blade 60, while the outer end portion 156 is elastically biased against a spacer member 170 which has a radial depth 174 similar to that of the base portion 168 and is located on the pivot axle 77, so that in reaction, the back side 164 of the central portion 158 is biased toward the inner face 166 of the flange 134. This pressure of the back side 164 against the inner face 166 keeps the spring 152 firmly engaged with the flange 134, so that it is unnecessary to have the spring attached to the frame side member 130 or captured by a fastener such as a rivet or other pin as in conventional jack knives.

In a similar fashion, another spring 152 is engaged with the flange 136 of the frame side member 132, also shown in FIG. 9. The opposite end portions 154 and 156 of the spring 152 shown associated with the flange 136 engage the base portion of the scissors 68 and another spacer 170. The springs 152 have a width 171, as may be seen in FIGS. 3 and 5, which approximates the thickness of the base portion 168, of the blade 60, and the base portion 172 of the scissors 68. The spacer members 170 each also have a thickness no less than and preferably slightly greater than the width of each spring 152, assuring that there is side clearance enough to allow movement of the end portions 154 and 156 of the springs 152.

The frame side member 130, with its flange 134, and the associated spring 152, the pivot axles 77 and 88, and a tool member such as the knife blade 60, with its base portion 168 located on the pivot shaft 88, and the spacer 170 located on the pivot shaft 77 taken together are a basic subassembly that could stand alone with the mere addition of a retaining element such as a head on each of the pivot shafts 88 and 77 wide enough to overlap a side of the end portion 154 or 156 of the spring 152, and a head or fastener on the other side of the frame side member 130 to prevent the pivot shafts 77 and 88 from moving axially out of engagement in the respective ends 144 and 146. As an alternative, the outer margin of the flange 134 could include a narrow lip 179 as shown in FIG. 9A.

The frame side member 132, including its flange 136, the associated spring 152, spacer 170, the scissors 68, and the pivot shafts 84 and 86 similarly are a basic subassembly of the handle 40. It will be understood, then, that several of such frame side members 130, each having its own flange 134, could be mounted on a pair of pivot shafts 77 and 88 without an internal frame member 90 or 92, with the flanges 134 similarly located and oriented, similarly located but facing toward each other to form a split channel, as shown in FIG. 9B, or oppositely located and facing toward the opposite frame side member as a box like frame having a tool bit or blade available on each side, as shown in simplified fashion in FIG. 9C.

Figure 10A:
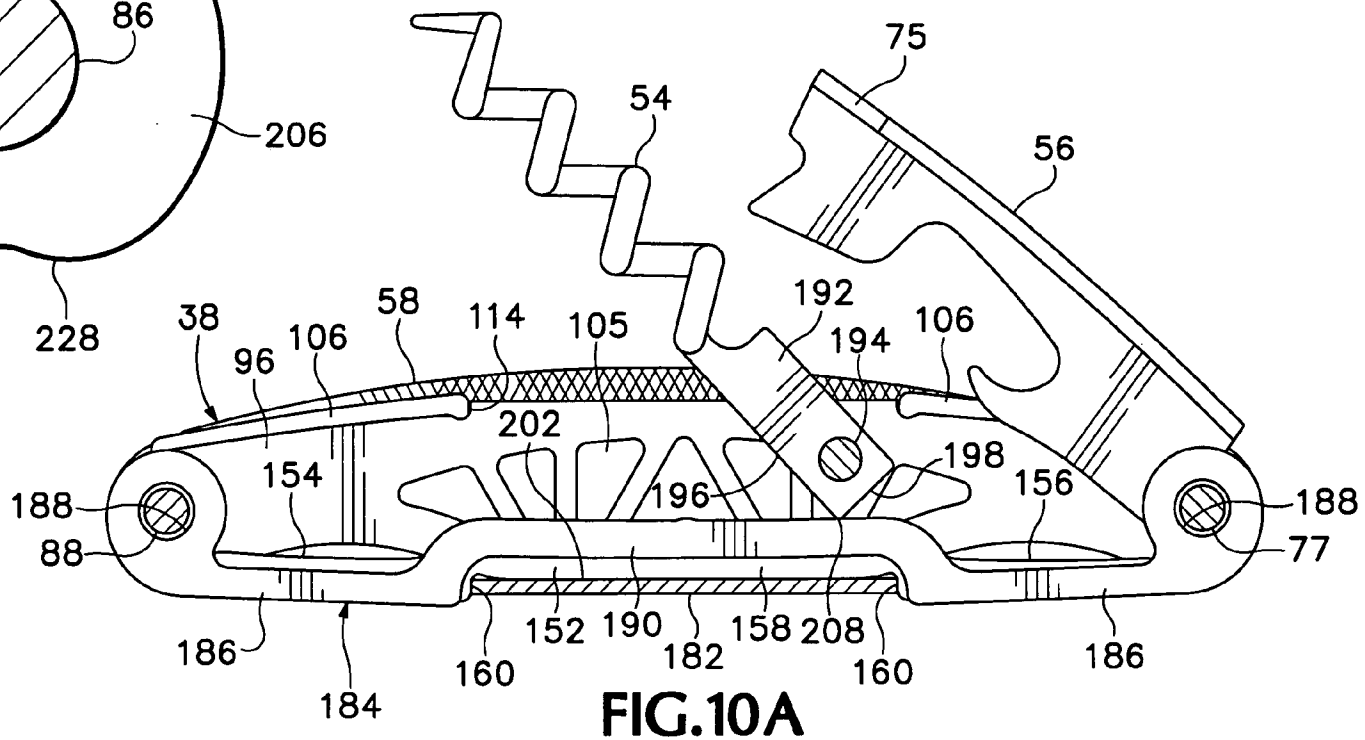
FIG. 10A is a view similar to the upper portion of FIG. 10, showing a cork puller rotated through an angle away from its folded position.

A frame side member 180, seen in FIG. 2 where the scale 72 has been cut away, has a flange 182 seen in FIGS. 10 and 10A. Alongside the frame side member 180, which is not shown in FIG. 10, except for its flange 182, is an elongate special spring 184 which has a pair of similar opposite end portions 186 each defining an opening 188 within which a respective one of the pivot axles 77 and 88 has a small amount of clearance. The end portions 186 extend toward a central portion 190, which is offset away from the flange 182 toward the base portion or tang 192 of the corkscrew 54. The tang 192 is attached to the frame side member 180 by a pivot pin 194 in the pivot joint 76. A flat engagement surface 196 on a side of the tang 192 lies alongside a central portion 190 of the spring 184, while another flat engagement surface 198 is also present on a bottom or inner end of the tang 192.

An elongate spring 152 is located behind the special spring 184 and has one of its opposite ends 156 biased against a surface of the base portion of the combined can opener and bottle opener 56, its central portion 158 biased against the inner face 202 of the flange 182, and the other one 154 of its opposite end portions biased against a spacer 170 located on the pivot axle 88.

In the portion of the handle 40 shown in FIGS.10 and 11, the drop point knife blade 66 is shown latched in its deployed position with an end portion 154 of the respective spring 152 engaged in a locking notch 204 of the base portion 206 of the knife blade 66, as will be explained in greater detail subsequently.

Referring now particularly to FIG. 10A, the combination can opener and cap lifter 56 has been removed from its stowed position in the handle 38 by pivoting about the pivot axle 77 to provide clearance for the corkscrew 54 to be raised from its stowed position shown in FIG. 10. As the corkscrew 54 is raised a corner 208 of its tang 192, defined by the intersection of the engagement surfaces 196 and 198, rides on the adjacent surface of the central portion 190 of the spring 184, deflecting the spring elastically toward the flange 182. The opposite end portions 186 simultaneously rotate through a small angle about the pivot axles 88 and 77, and the spring 184 urges the corkscrew 54 toward a stable position either stowed, as shown in FIG. 10, or extending perpendicular to the handle 38 with the engagement surface 198 resting on the central portion 190 of the spring 184, which facilitates turning the corkscrew 54 into a cork to be removed from a bottle.

Figure 11:
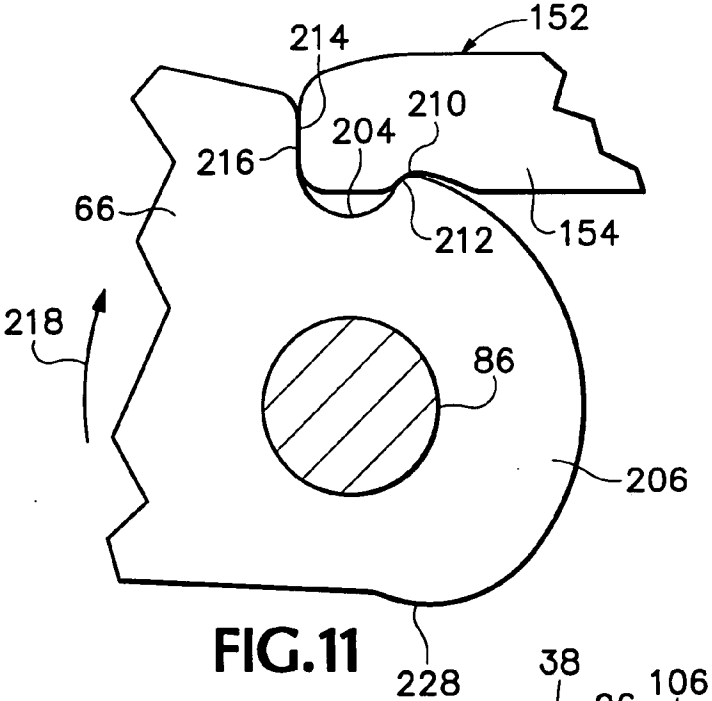
FIG. 11 is a detail view, at an enlarged scale, showing a base portion of the knife blade shown deployed in FIG. 10, together with a portion of a spring acting on the knife blade as a lock to hold it in its deployed position.

FIG. 11 shows in greater detail the engagement of one of the outer end portions 154 of one of the elongate beam springs 152 with the base portion 206 of the knife blade 66 in its deployed position as shown in FIG. 10. A peripheral surface of the base portion 206 includes a detent cam portion 210 defining one side of the blade locking notch 204, and a shallow notch in the outer end portion 154 of the spring 152 defines a detent catch 212 that engages the notch 204 when a tool member such as the knife blade 66 is in the deployed position. Engagement of the detent catch 212 in the locking notch 204 increases the force required to move the deployed tool member away from the deployed position, as compared with a merely flat surface on the outer portion 154 of the spring and a corresponding parallel flat surface in place of the detent cam surface shown at 210.

An abutment surface 214 of the base portion 206 rests against an end surface 216 of the elongate spring 152, that counteracts forces tending to move a tool member about the respective axle in the direction indicated by the arrow 218. When such a force is directed by the abutment face 214 into the spring 152 through its end face 216, the force is carried through the end portion 154 of the spring 152 to the abutment shoulder 160 and thence to the end face 222 of the flange 220 of the frame side member 142. Because the distance between the abutment shoulders 160 of the central portion 158 is only a very small distance greater than the length 224 of the flange 220, when the outer end portion 154 of the spring 152 associated with the flange 220 is flexed by engagement of the outer end portion 154 with the base portion 206 of the knife blade 66 or another tool member, the abutment shoulders 160 closely approach or contact the end faces 222 and the spring 152 is prevented from moving appreciably with respect to the flange 220, so that the tool member, such as the knife blade 66, is held steadily in its deployed position as shown in FIGS. 10 and 11. Similarly, the springs 106 retain the pliers jaws 32 and 34 in their deployed positions as end faces of the springs 106 bear against abutment faces 226 on the base portions 42 and 44 of the jaws 32 and 34, shown in FIGS. 5 and 8.

Corresponding arrangements of cam surfaces, blade locking notches, and detent dogs are preferably provided on all of the springs 106 and 152 and may be provided on the base portions of all of the tool members or blades. The base portion of each of the tool members or blades preferably includes a cam profile followed by an end portion of the respective spring 106 or 152, which easily permits movement of each tool member between a position near its stowed position within one of the handles 38 or 40 and a position approaching its deployed position. For any of the tool members or blades other than the short screwdriver blades 46, 48, 50, and 52, the base portion preferably also includes a slightly protruding cam lobe 228 located so that pressure on the cam lobe 228 from the elastically biased outer end portion 154 of a spring 152 or outer end portion 108 or 110 of a spring 106 urges the respective tool member or blade into its respective stowed position within one of the handles 38 or 40. Such camming action and latching action of the springs on the blades and tool members strengthen a perception of precision in the tool 30.

As shown in FIG. 12, the pivot axles 77 and 88 fit snugly through precisely aligned holes provided in the scale 72, the frame side member 180, the spring 184, the frame side members 94 and 96 of the internal frame 90, and the frame side members 138 and 130, and finally through a scale 78. The base portions of selected blades and tool members, as previously shown, also include through holes, through which the pivot axles 77 and 88 fit snugly and rotatably, and for each place adjacent one of the frame side members 130, 132, 142, etc., where there is no tool member or blade, there is a corresponding spacer 170, none of which are shown in FIG. 12. The interconnection of the various frame side members and internal frame side members, with tool members and blades in place, may be seen in detail in FIG. 13.

Figure 13:
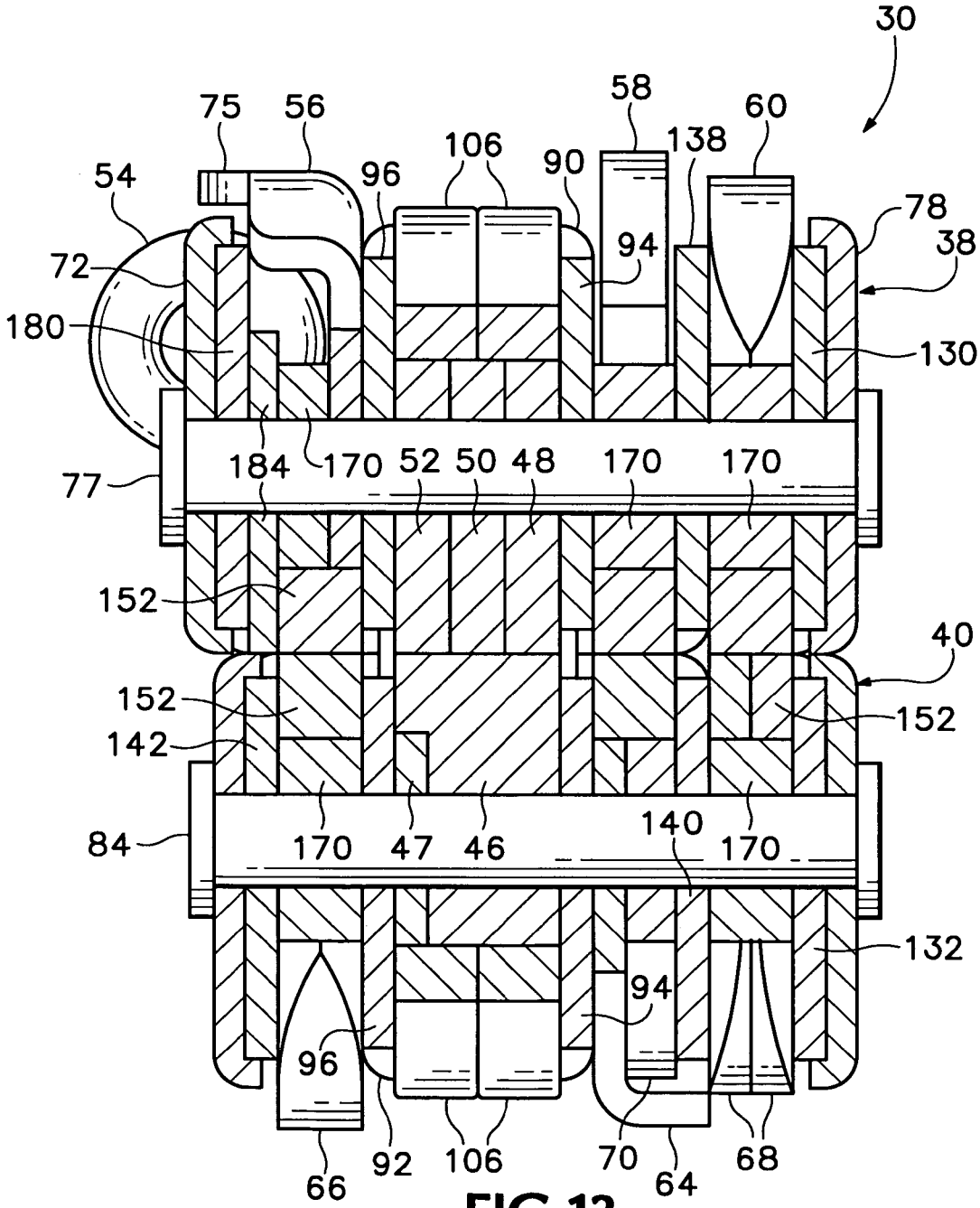
FIG. 13 is a sectional view, at an enlarged scale, taken along line 13—13 in FIG. 6.
Figure 14:
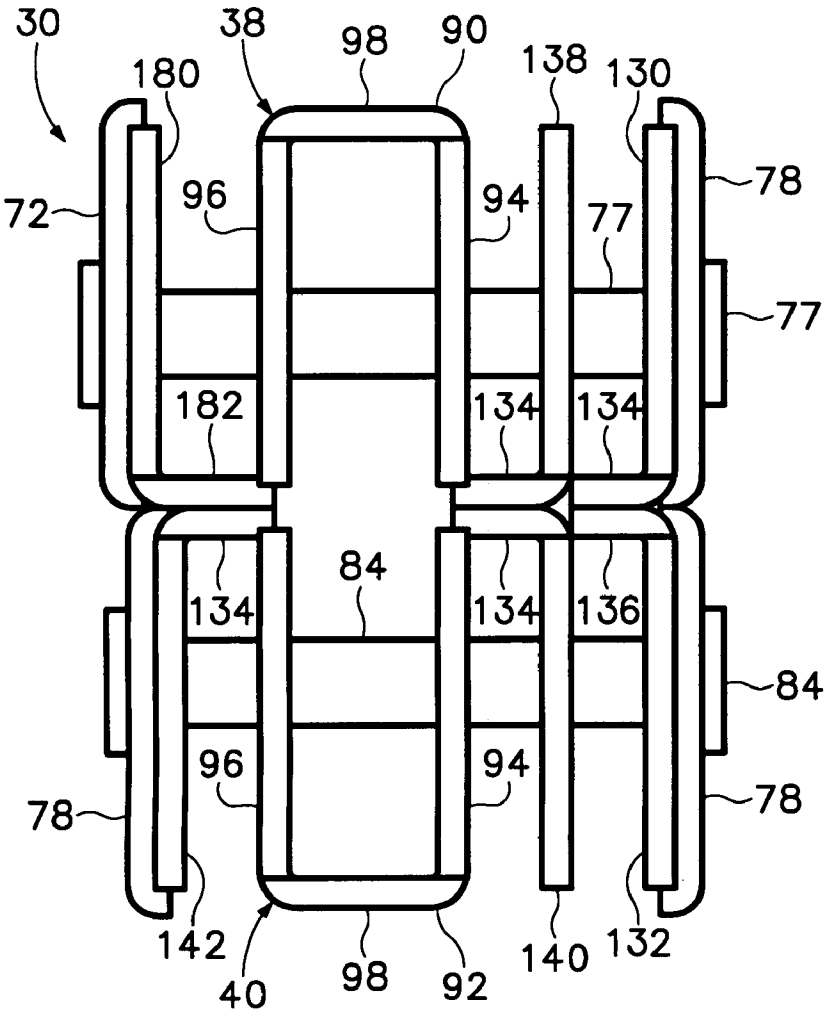
FIG. 14 is an end view taken in the same direction as FIGS. 3 and 13 showing the handles and pivot axles of the folded tool shown in FIG. 2 without the tool members and blades.

The frame side members and internal frames of the handles 38 and 40 are shown together with the pivot axles 77 and 84 and the handle scales 72 and 78 in FIG. 14, as seen from the same direction as in FIGS. 3 and 13.

Figure 15:
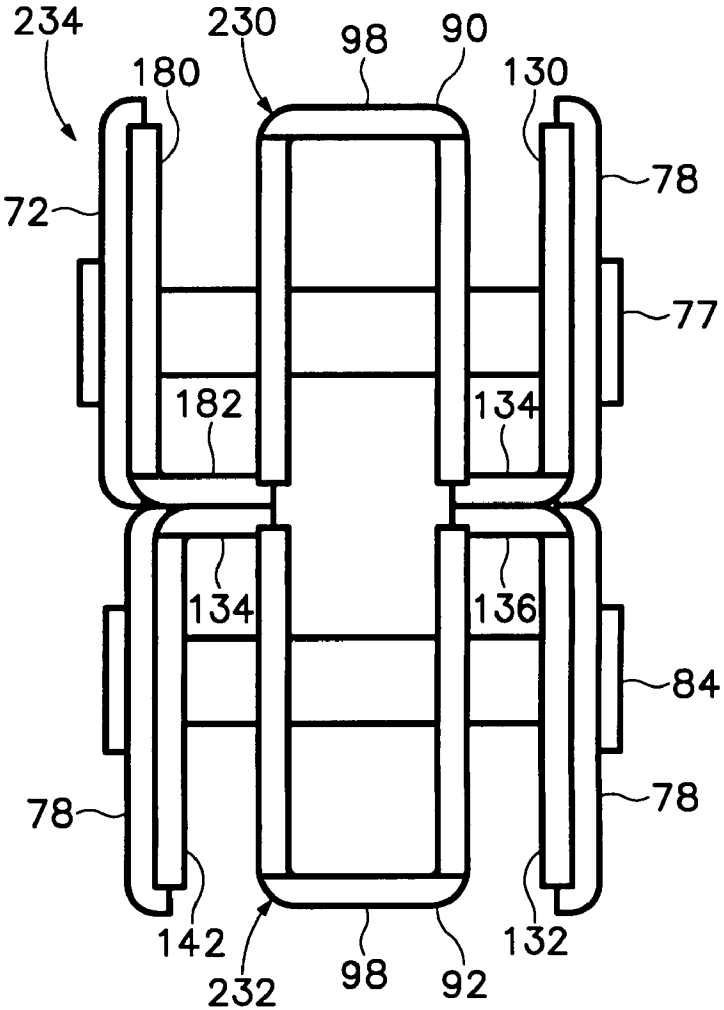
FIG. 15 is an end view similar to FIG. 14, showing the handles of a folding tool similar to that shown in FIG. 14 and embodying the invention but having fewer frame side members.

In FIG. 15 are shown the handles 230 and 232 for a folding multipurpose tool 234 basically similar to the tool 30, but in which fewer outer frame side members are included. Room is thus available for fewer tool members and blades, although a frame side member 180 affording room for the corkscrew 54 is included.

Figure 16:
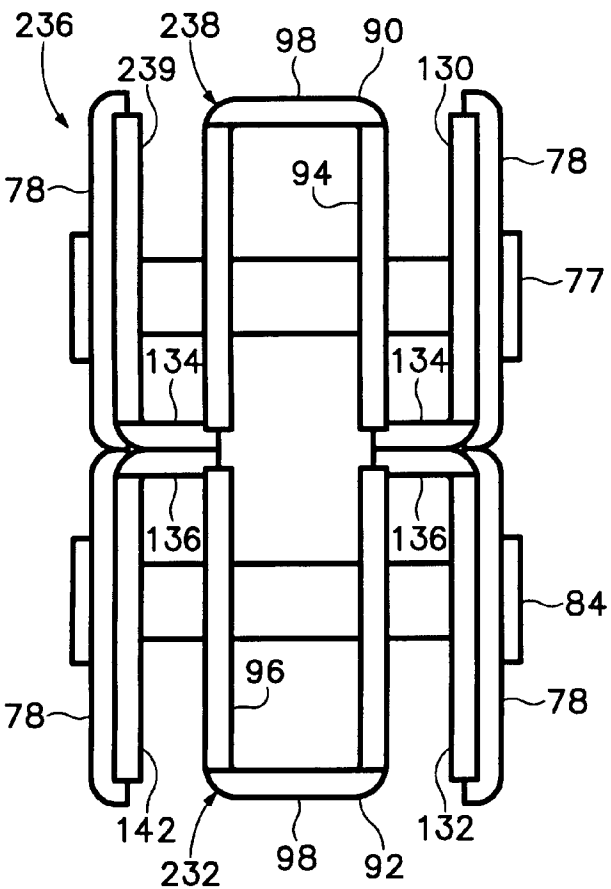
FIG. 16 is an end view similar to FIG. 15, showing the handles of a folding tool similar to that shown in FIG. 15 which is another embodiment of the invention.

In a multipurpose folding tool 236 which is another different embodiment of the invention, whose handles are shown similarly in FIG. 16, without springs or tool members or blades, room is provided by external frame side members with flanges and associated springs for a similar number of tool members and blades, with the exception that there is a frame side member 239 of the same type as the frame side member 130 instead of a frame side member 180 that would allow installation of a corkscrew 54 among the tool members in the upper handle 238.

Figure 17:
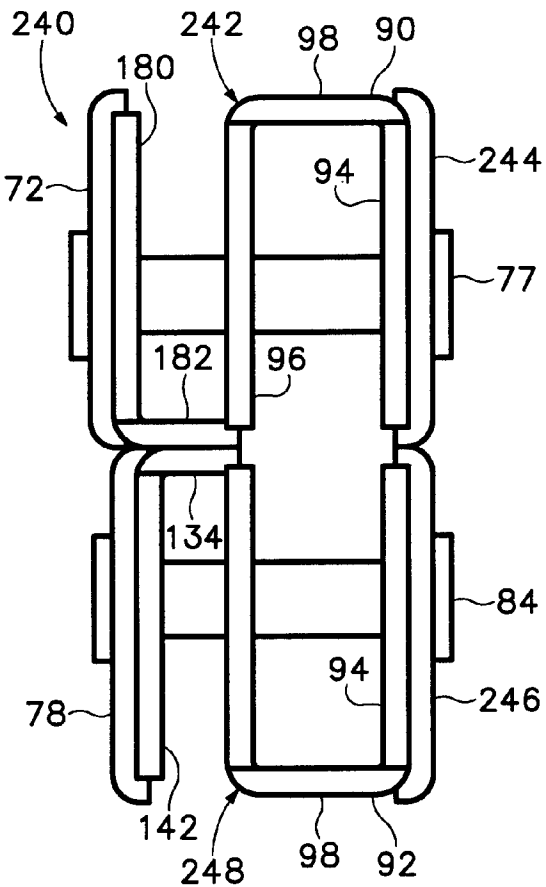
FIG. 17 is an end view similar to FIGS. 14, 15, and 16, showing the handles of a folding tool which is another embodiment of the invention in which each handle has an interior frame member including a channel and a single external frame side member in addition to the interior frame member.

Shown in FIG. 17 are the handles for a folding multipurpose tool 240 that is an even simpler embodiment of the invention, depicted in the same skeleton fashion. Such a tool 240 includes a space in an upper handle 242 to receive a corkscrew 54 in an external handle subassembly including a frame side member 180, while a pair of mirror opposite scales 244 and 246 are utilized on the frame side members 94 of the internal frames 90 and 92 of its handles 242 and 248.

Figure 18:
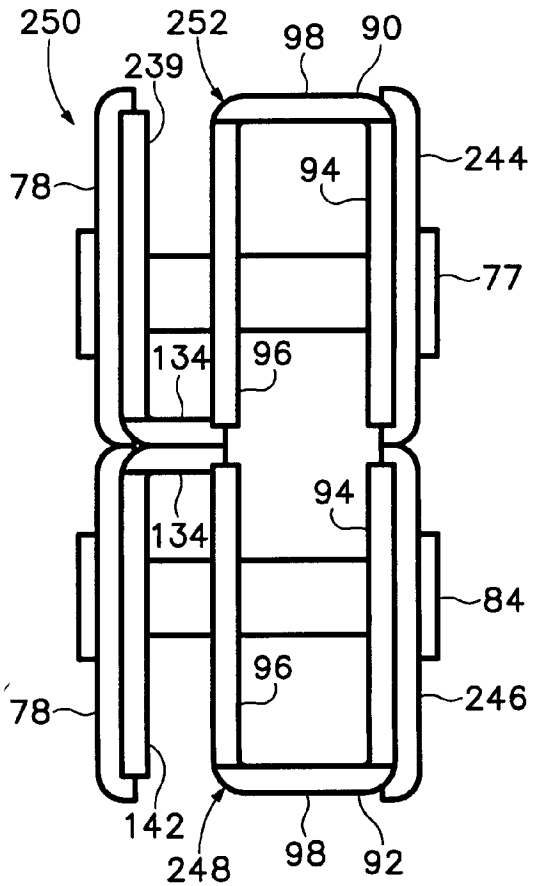
FIG. 18 is an end view similar to those of FIGS. 14–17, showing the handles of a folding tool similar to that shown in FIG. 17, which is another embodiment of the invention.

A pair of handles for a similar but slightly different folding tool 250, shown in FIG. 18, also has a frame side member 239 similar to the frame side member 130 instead of a frame side member 180 in its upper handle 252, which is otherwise similar to the handle 242. The lower handle 248 is similar to that shown in FIG. 17.

In assembling a multipurpose tool according to the present invention, a pair of pivot axle members 84 and 86 such as suitable rivets are first inserted into the corresponding holes at the opposite outer ends of the appropriate scale 78 and the frame side member 142, with its flange 220. With the frame side member 142 and scale 78 firmly seated on the pivot axles 84 and 86, the frame side member 142 and the scale 78 are held clamped in a suitable fixture (not shown). A spring 152 is clamped in place on the frame side member 142, with its central portion 158 seated snugly against the flange 220. Next, the outer end portions 154 and 156 are both pushed away from the pivot axles 84 and 86 far enough to provide clearance for installation of the base portion 206 of a tool member such as the knife blade 66 and the spacer member 170, respectively, onto the pivot axles 86 and 84. Then, once the end portions 154 and 156 are released to press elastically upon the base portion 206 and spacer member 170, as well as the inner face 166 of the flange 220, the subassembly 254 thus completed will remain assembled as a unit.

Figure 20:
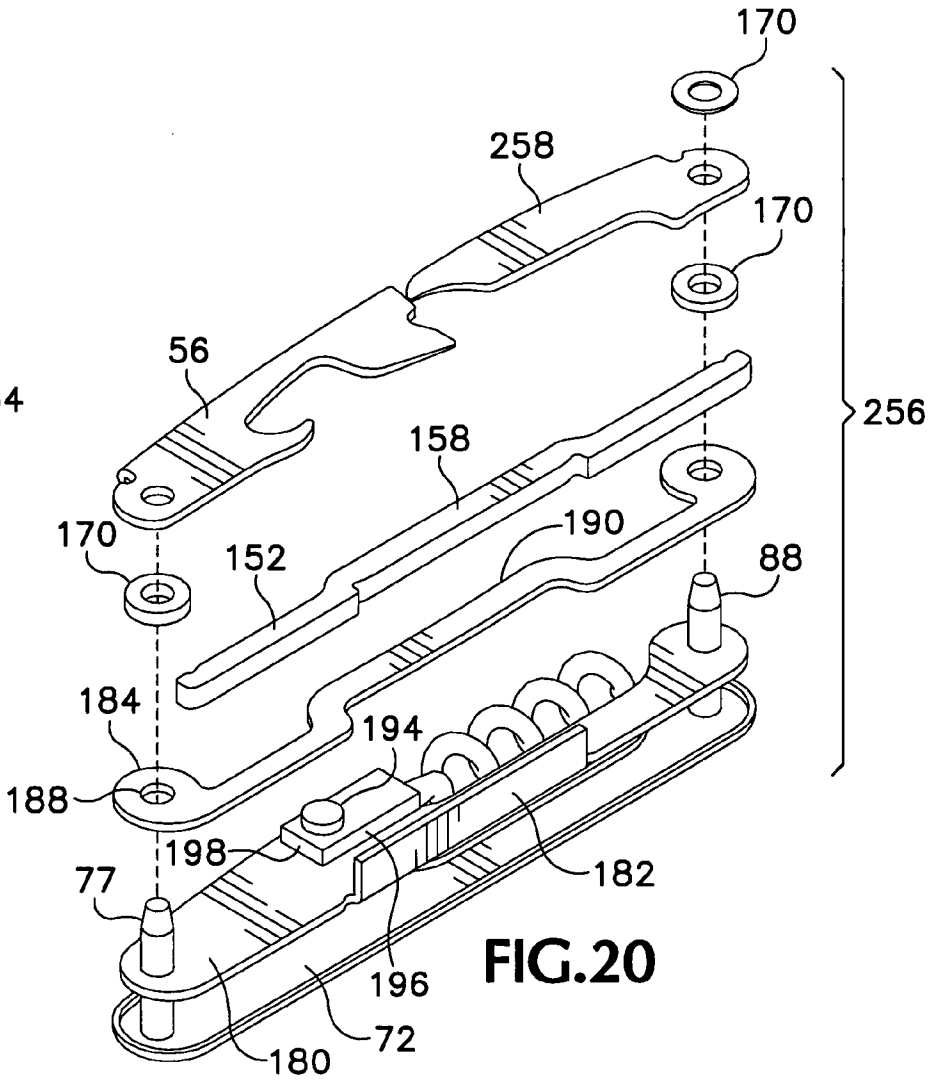
FIG. 20 is a view similar to FIG. 19, showing parts of a handle for a folding tool which is a different embodiment of the invention, also at a first stage of the procedure of assembling the tool.

Similarly, the subassembly 256 shown in FIG. 20 in an exploded view is assembled by first fastening the rivet or other pivot pin 194 to connect the tang 192 of the corkscrew 54 to the frame side member 180 and then inserting the rivets which will become the pivot axles 77 and 88 through the scale 72 and the frame side member 180. Preferably, the scale 72 includes a hole that fits closely about the exposed end of the pivot pin 194. Next, the spring 184 is placed onto the pivot axles 88 and 77, and flexed somewhat, and then placed adjacent the frame member and alongside the engagement surface 196 of the corkscrew tang 192, and then a spring 152 is placed atop the spring 184 with its central portion 158 resting on the flange 182 and clear of the tang 192. These members are clamped together in a fixture (not shown), and force is applied to the end portions 154 and 156 of the spring 152 to provide clearance for installation of the appropriate spacers 170 and the combined can opener and corkscrew brace 56, respectively, onto the pivot axles 88 and 77. A small tool bit or blade such as a finger nail tool 258 (not shown in FIG. 1) may be fitted on the pivot axle 88 with spacers 170 of the appropriate thicknesses.

Figure 19:
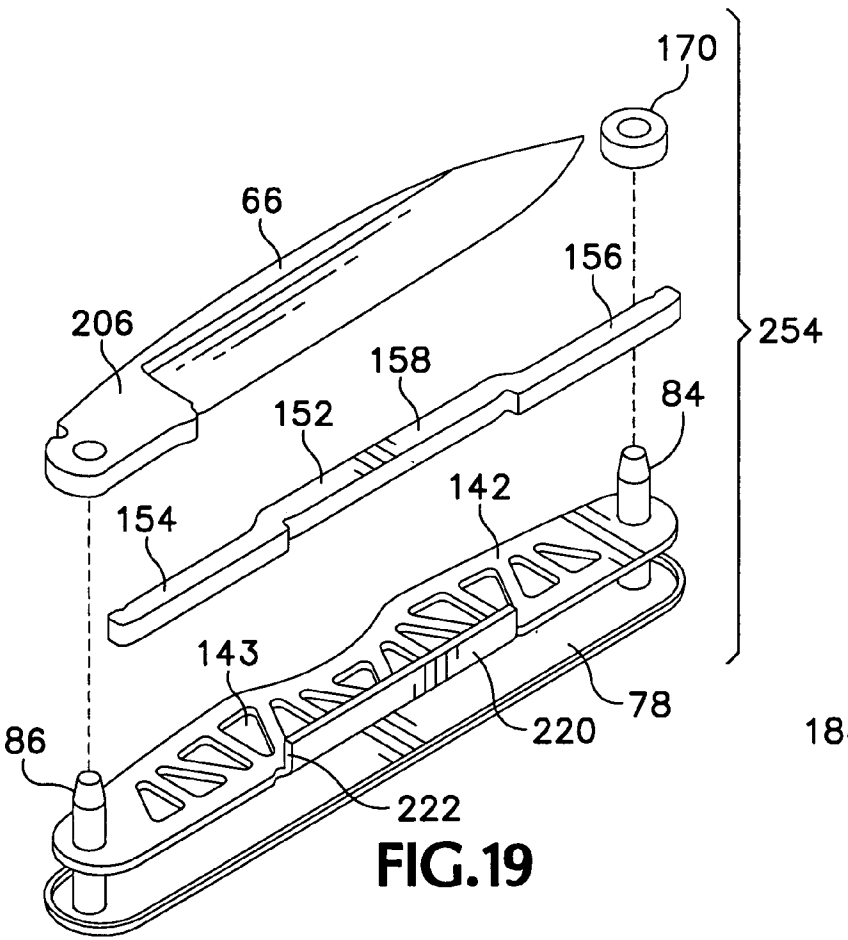
FIG. 19 is an exploded view showing a portion of a partially-assembled folding tool embodying the present invention at a first stage of the procedure of assembling the tool.
Figure 21:
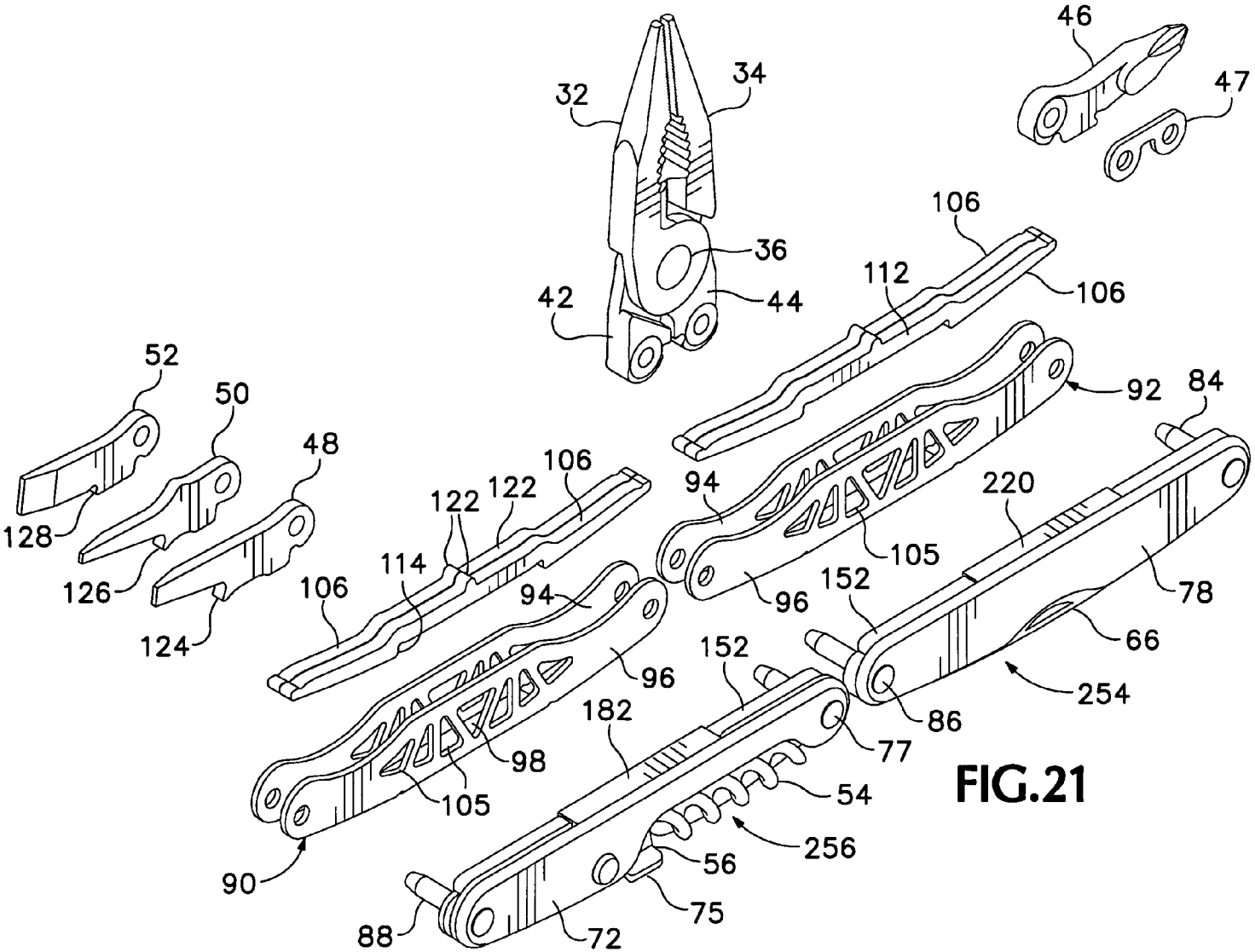
FIG. 21 is a partially exploded view of a portion of a partially-assembled folding tool according to the present invention at a later stage of assembly of the tool than is shown in FIGS. 19 and 20, illustrating the assembly of internal frame portions of the handles of the tool with a pair of pliers included as part of the tool.

Referring next to FIG. 21, after assembly of the subassemblies 254 and 256 shown in FIGS. 19 and 20, the pair of springs 106 is placed into each of the interior frames 90 and 92 engaging the flange 98. A suitable fixture is preferably utilized to clamp the springs 106 onto the internal frames 90 and 92 with enough pressure applied to the end portions 108 and 110 of the springs 106 to provide clearance for installation of tool members such as the screwdriver blades 48, 50, and 52 into the internal frame member 90, and the screwdriver 46 and lanyard link 47 into position in the internal frame 92, as well as to place the base portions 42 and 44 of the pliers jaws 34 and 32 into place between the frame side members 94 and 96 of each internal frame 90 and 92. The pivot axles 77, 84, 86, and 88 of the subassemblies 240 and 242 are then inserted through the appropriate holes defined in each of the frame side members 94 and 96 of each internal frame 90 and 92. Once the frame side member subassemblies 254 and 256 have been placed alongside the internal frame members 90 and 92, with the pivot axles 77, 84, 86, and 88 in place, the fixtures can be released, and the springs 106 will then be elastically biased to press against the base portions of the screwdriver blades 46, 48, 50 and 52 and pliers jaws 32 and 34.

Figure 22:
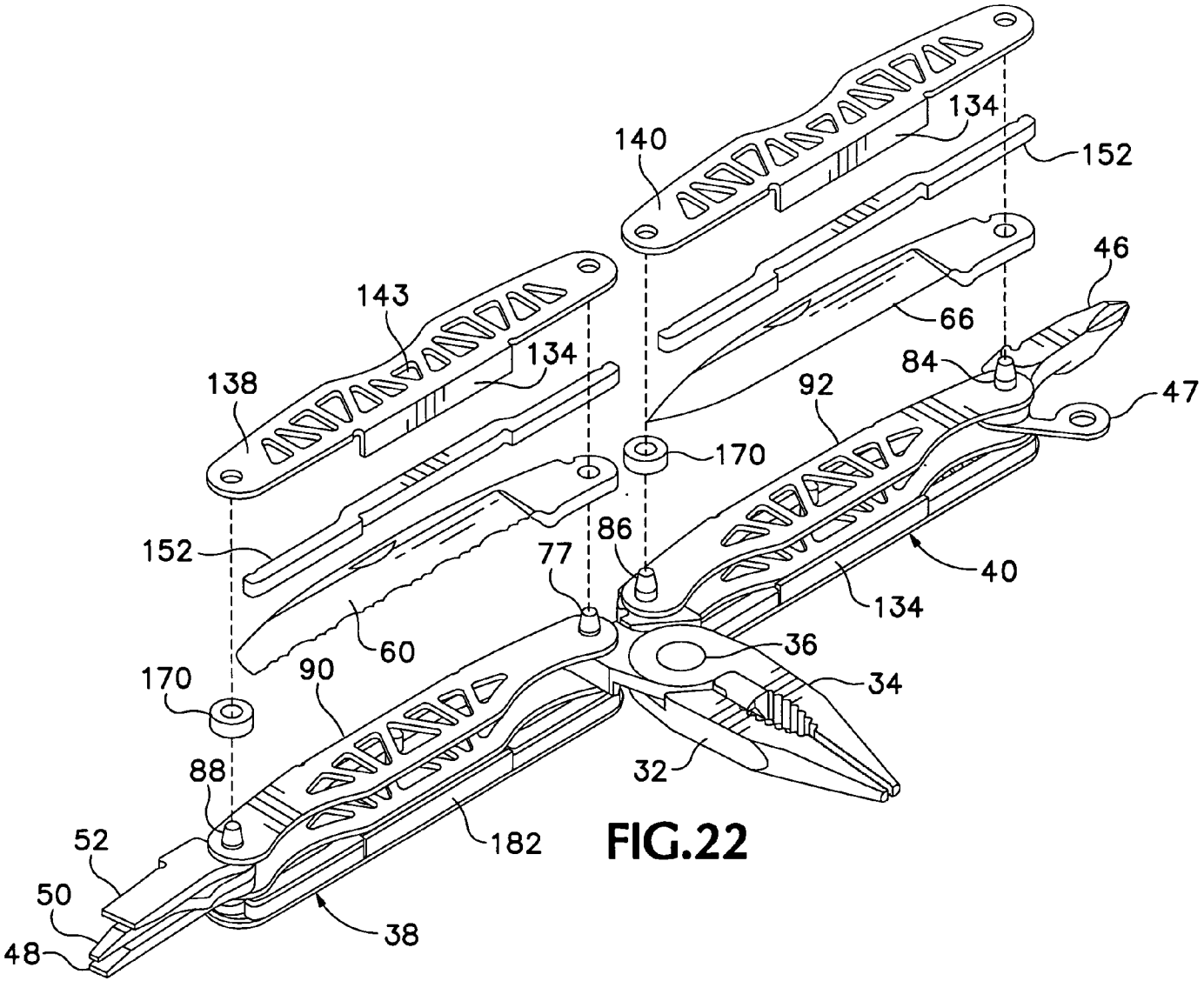
FIG. 22 is a partially exploded view showing assembly of additional parts of a folding tool according to the present invention at a stage of the assembly procedure following that shown in FIG. 21.

Thereafter, as shown in FIG. 22, the subassembly resulting from the operations described in connection with FIG. 21 is turned over to expose the outer ends of the pivot axles 77, 84, 86 and 88, and the next desired blades and spacers 170 are placed over the upwardly directed ends of the pivot axles. Respective springs 152 are placed into position atop the frame side members 94 alongside the blades and spacers and clamped into place. The frame side members 138, 140 are placed with their respective flanges 134 pressed against the central portions 158 of the springs 152, and the external frame side members 138 and 140 are placed onto the pivot axles 77, 84, 86, and 88 and pushed down snugly against the internal frame members 90 and 92. Additional tool members or blades, springs, and external frame side members (not shown) may also be added, provided long enough pivot axles are used.

As a final step, the scales 244 and 246 are placed onto the pivot axles 77, 84, 86 and 88, which are then riveted or otherwise fastened to hold the several frame side members, tool members, blades, and scales together with the precisely required amount of axial clearance along the pivot axles to permit the blades and other tool members to be moved without undue force being required. Rivets may be formed in accordance with U.S. patent application Ser. No. 09/631,876, now U.S. Pat. No. 6,442,823, or U.S. Pat. No. 5,855,054.

Figure 23:
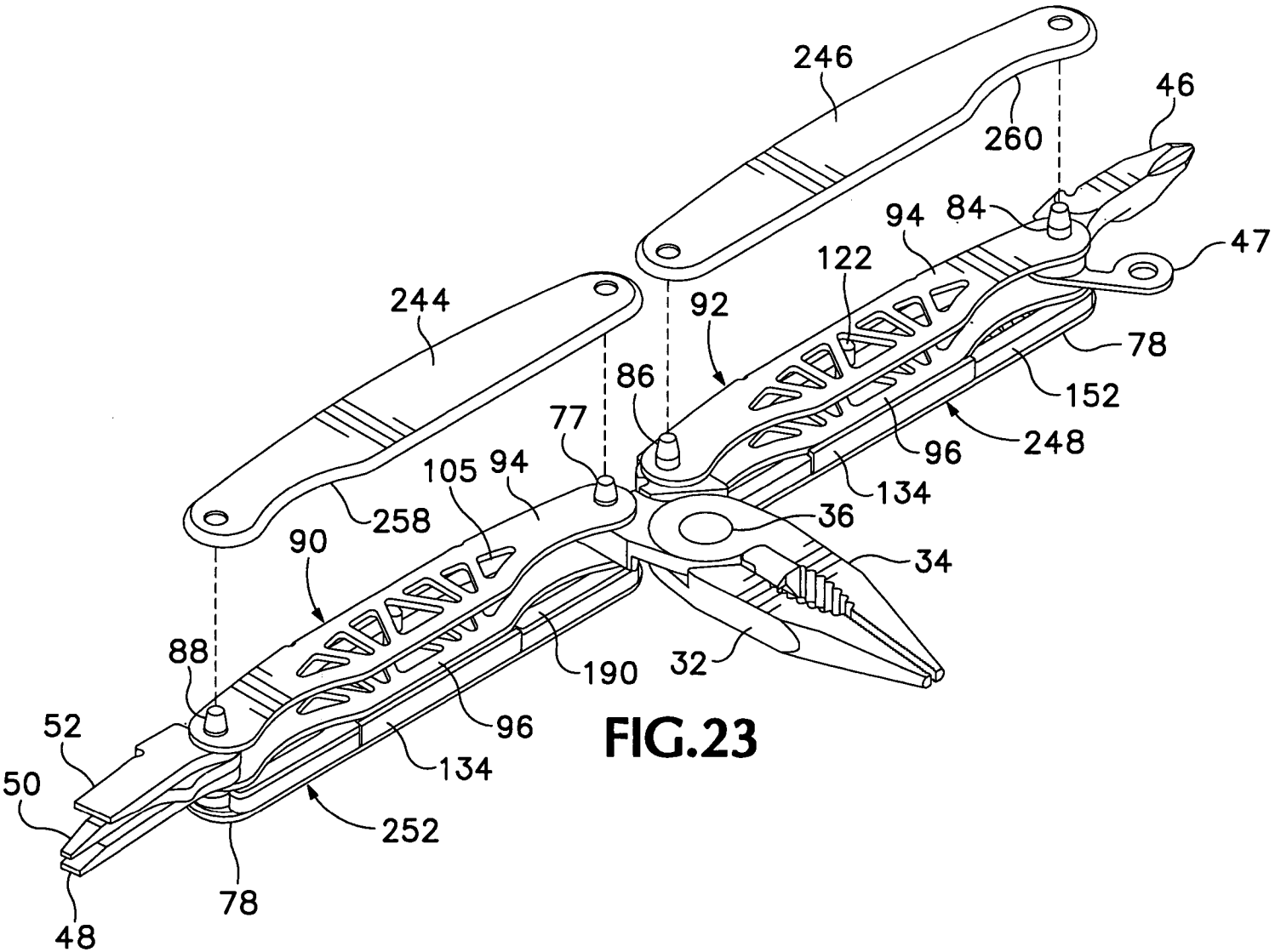
FIG. 23 is a partially exploded view of a folding tool according to the present invention showing installation of handle scales on a nearly completely assembled tool.

The scales 244 and 246 shown in FIG. 23 have nail nick access indentations 258 and 260 near their ends, in contrast with the centrally located indentations 80 on the scales 78 of the handles shown in FIG. 4, since the scales 244 and 246 fit alongside the interior frame side members 94 and 96. The several shapes of the scales 72, 78, 244 and 246 all provide a pleasing profile for each handle 38, 40, etc. Each may be made of materials selected for appearance and is shaped to fit around the edges of the frame side member and provide comfortably rounded margins for the handles, so that the tool can be carried comfortably in one's pocket.

Figure 25:
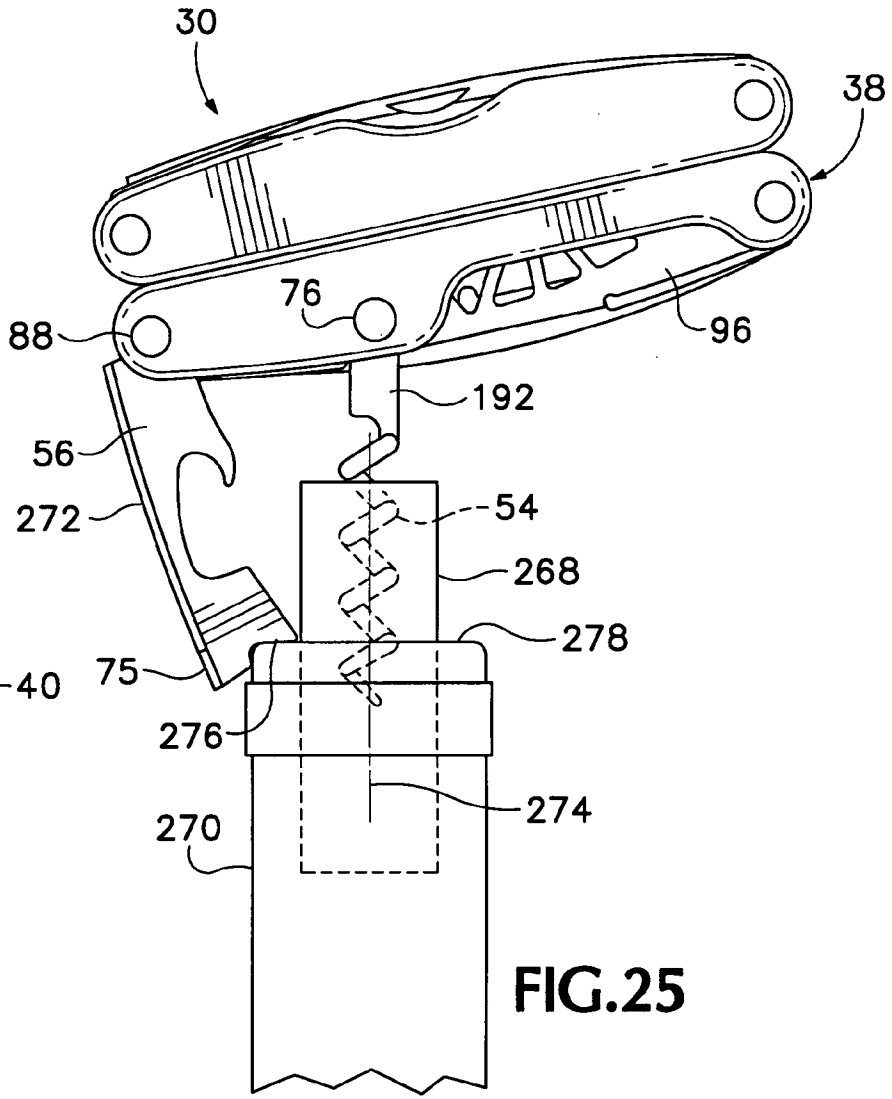
FIG. 25 is a view similar to FIG. 24, showing a further stage in the procedure of removing a cork from a bottle using the tool shown in FIG. 24.
Figure 24:
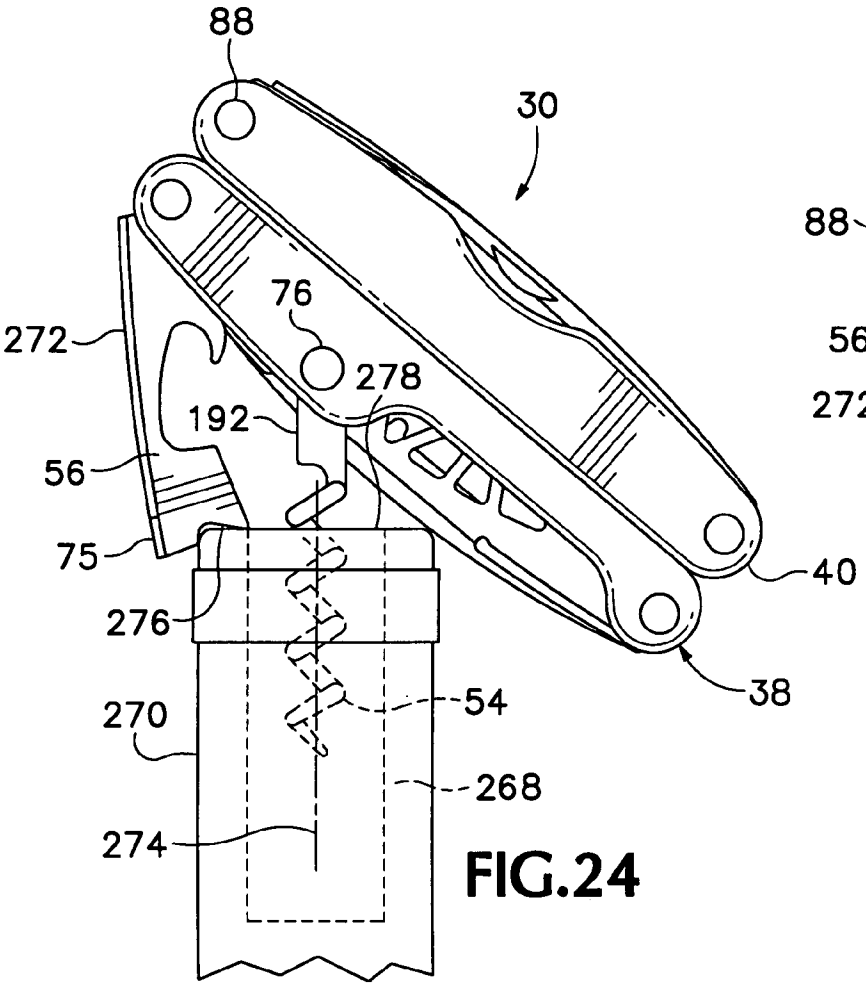
FIG. 24 is a side elevational view of a folding tool according to the present invention showing the use of a cork puller included in the tool.

Regarding operation of the corkscrew 54 and its associated brace portion 56, as shown in FIGS. 24 and 25, the folding multipurpose tool 30 of the present invention is used to remove a cork 268 from a bottle neck 270 in a manner generally similar to that used with the well-known "waiter type" corkscrews. A flange 272 stiffens the corkscrew brace 56. Additionally, a wider portion 75 of the flange 252 extends laterally outward near the corkscrew 54 to facilitate engaging the brace 56 with one's thumb to extend the brace 56 and thus provide clearance to move the corkscrew 54 to a perpendicularly extended position with respect to the handle 38. The corkscrew 54 is held in this extended position by the pressure of the central portion 190 of the spring 184 against the engagement surface 198 of the tang 192 of the corkscrew 54, as may be seen in FIG. 10A. With the brace 56 kept far enough away, the corkscrew 54 can be threaded conveniently into the cork 268. Since the brace 56 is located alongside the frame side member 180 of the handle 38, the foot 276 is easily placed atop the lip 278 of the bottle neck 270 after the corkscrew 54 has been threaded into the cork 268, by rocking the handle 38 about the pivot joint 76 that attaches the tang 192 to the frame side member 180. Although the foot 276 is slightly to one side of the longitudinal axis 274 of the corkscrew 54, the brace 56 adequately supports that end of the handle 38 so that the pivot axle 88 acts conveniently as a fulcrum about which the handle 38 is pivoted with respect to the brace 56. At the same time the tang 192 of the corkscrew 54 pivots simultaneously about the pivot joint 76 as the corkscrew 54 raises the cork 268 when the handle 38 is raised and pivoted about the pivot axle 88. Pressure of the central portion 190 of the special spring 184 against the corner 208 and the engagement surface 198 of the base 192 of the corkscrew 54 urges the corkscrew 54 toward its perpendicularly extended position as the handle 38 is raised to pull the cork 248 from the bottle neck 242.

A folding multipurpose tool 300 which includes folding pliers 302 is shown in FIGS. 26–33. The tool includes a pair of handles 304, 306 that are of generally similar construction. Each of the handles 304, 306 is attached to a respective one of a pair of pliers jaws 308, 310 and to an associated rocker 312, 314, by a respective one of a pair of pivot axles 316 and 318 at a first end 319 of the handles. The pliers jaws 308, 310 are interconnected with each other by a pivot joint 320.

Figure 27:
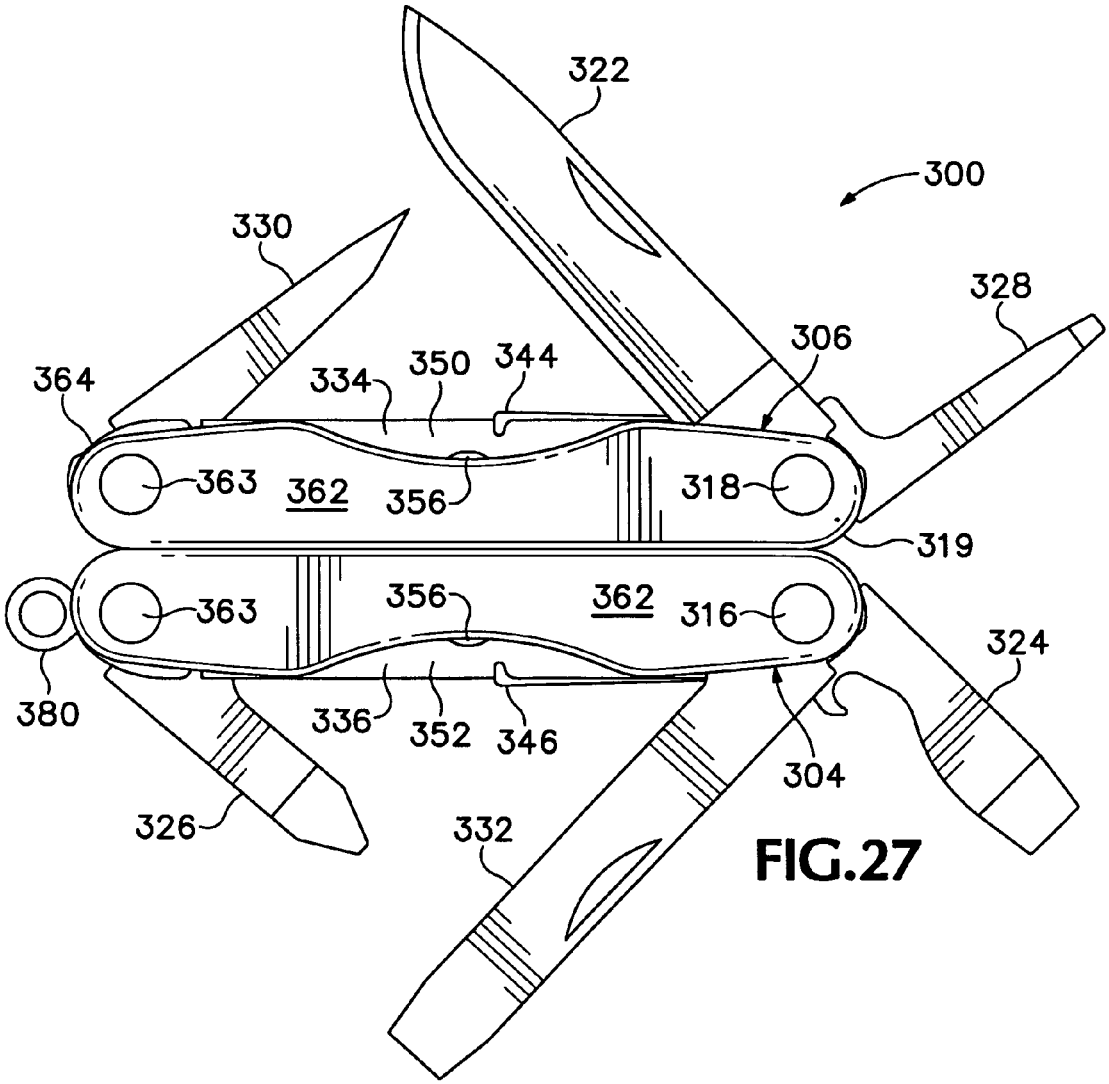
FIG. 27 is a side elevational view of the tool shown in FIG. 26, with the pliers jaws folded and several folding blades deployed.

As shown in FIG. 27, the multipurpose tool 300 may include various other folding blades, such as a knife blade 322, screwdriver blades 324, 326 and 328, an awl 330, and a file 332, or other blades or tool bits of suitable sizes to fit within a pair of side slots 334, 336 defined in each of the handles 304, 306.

Figure 26:
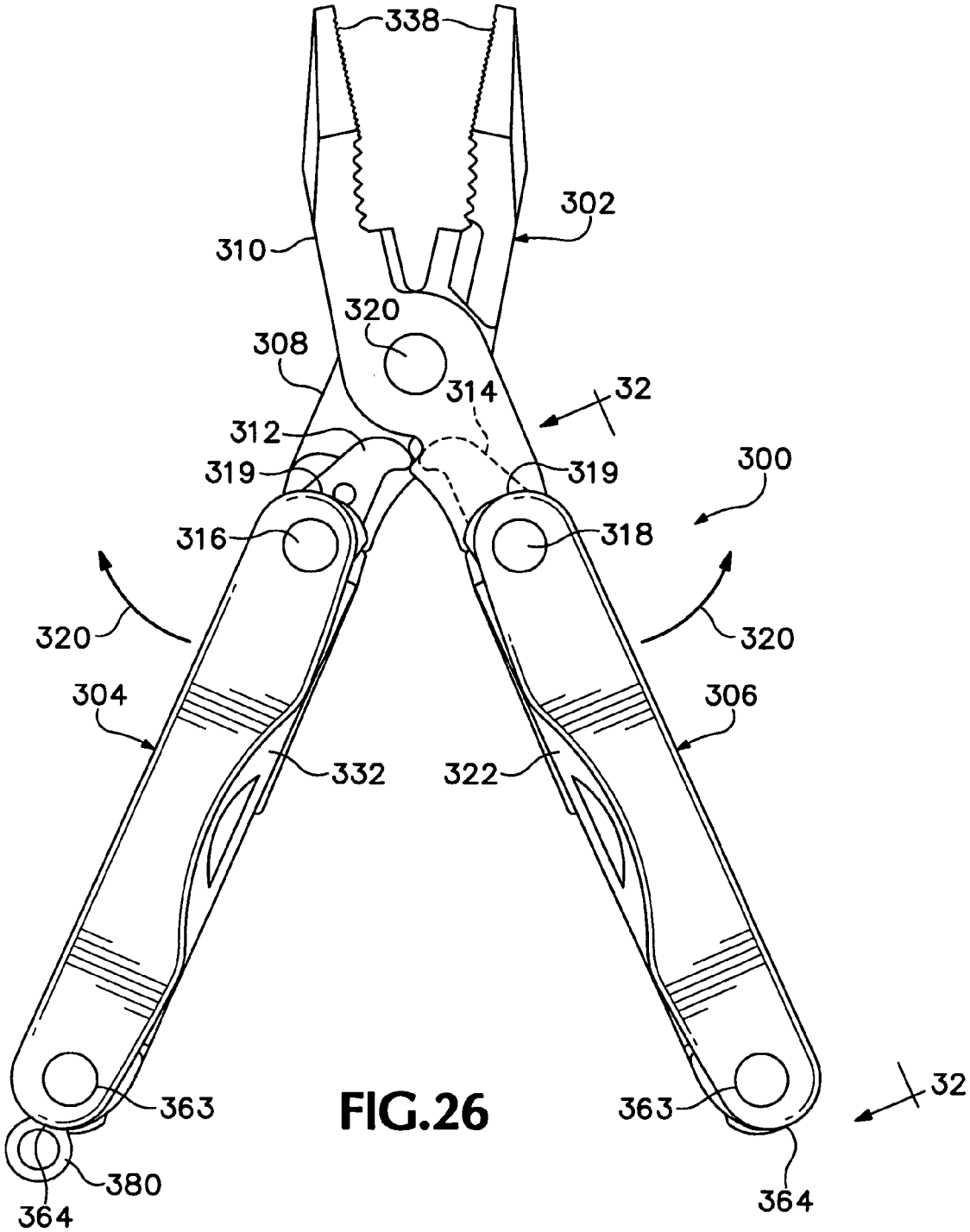
FIG. 26 is an elevational view of folding multipurpose tool including folding pliers which is an embodiment of an additional aspect of the present invention, showing the tool with the pliers deployed for use.

The handles 304, 306 can be rotated with respect to the jaws 308, 310 about the pivot axles 316, 318, as indicated by the arrows 320 in FIG. 26, to place the pliers either into a folded configuration as shown in FIGS. 27–31, in which the pliers jaws 308, 310 are housed within and between the handles 304, 306, or a deployed configuration as shown in FIG. 26.

The pliers 302, with the jaws 308, 310 in a closed position with their jaw tips 338 close together, fit within central channels 340 defined in the handles 304, 306. The interiors of the central channels 340 face toward each other when the multipurpose tool 300 is in the folded configuration as shown in FIGS. 27–31.

As may be seen in FIG. 26 a respective one of the rockers 312, 314 is located alongside the base portion of each of the pliers jaws 308, 310 and is mounted on the same one of the pivot axles 316 and 318. Each rocker is preferably linked together with the base portion of the adjacent pliers jaw as explained in Berg et al. U.S. Pat. No. 5,745,997.

A pair of elongate beam springs 344, 346 is located in the central channel 340 of each of the handles 304, and 306. Free or outer ends of the beam springs 344 act on the bases of the pliers jaws 308 and 310 to maintain the position of each relative to the respective handle 304 or 306, while free or outer ends of the other beam springs 346 act on the rockers 312 and 314 to urge the pliers jaws 308 and 310 about the pivot joint 320 to an open position with respect to each other when the pliers jaws are deployed as shown in FIG. 26, or to urge the jaws 308, 310 and handles 304, 306 toward one another to keep the multipurpose tool in the folded configuration shown in FIGS. 27–31. It will be understood that in a tool not utilizing the above-mentioned rocker arrangement a single spring 344 bearing on the base of the jaw 308 or 310 may be used in each of a pair of handles 304, 306.

The two handles 304 and 306 are essentially similar except for the particular tool blades included, and so in general only the handle 306 will be described in detail, with reference to FIGS. 29–37.

The central channel 340 of each handle 304 or 306 is defined by a pair of frame side members 350, 352 extending parallel with each other and a center flange 354 extending transversely between the frame side members. In a preferred embodiment of the folding tool 300, the center flange 354 and side members 350, 352 are constructed as a single piece of sheet steel bent along parallel lines as may be seen in FIG. 34 so that the center flange 354 interconnects the frame side members 350, 352 with each other. To minimize the weight of the tool 300 the frame side members may be lightened by appropriate removal of metal to define openings 356 seen in FIGS. 33–37.

Each of the side slots 334, 336 is defined by a respective side flange 358 or 360 extending laterally outward and away from the central channel 340 and located along an outer margin of a respective frame side member 350 or 352, opposite the center flange 354. While the side flanges 358 and 360 are parallel with the flange 354 interconnecting the side member 350 and 352, it will be understood that such parallelism is not required in every case.

Adjacent each of the side flanges 358, 360, and oriented parallel with, but spaced apart from, the adjacent one of the frame side members 350 and 352, is a handle scale or outer side plate 362 attached to the handle frame by the respective pivot axle 316 or 318 at the first end 319 of the handle, where the pliers jaw and rocker are attached to the handle. One of the handle scales 362 defines one of the sides of each side slot 334 or 336, and may be attached at the opposite, or second, end 364 of each handle 304 or 306 by a fastener such as a rivet or pivot axle 363. Each handle scale or plate 362 may be of an aluminum alloy to keep down the weight of the tool 300, and is kept spaced apart from the adjacent one of the frame side members 350, 352 defining the central channel 340 either by the base of a respective one of the tool bits or blades 322, 330, etc., or by a respective spacer, to provide the desired width for each side slot 334 or 336 between the handle side plate or scale 362 and the side member 350 or 352 of the handle frame.

A cantilever spring 366 or 368 extends longitudinally from each of the laterally outwardly projecting side flanges 358 and 360, and bears upon a base portion of one of the folding tool blades or bits 322, 324, etc., to retain each blade or bit in either an opened or folded position by a camming action.

Each pivot axle 312, 314 or 363 may be a suitable fastener, such as a screw or an appropriate rivet. Such a rivet may preferably be fastened in accordance with U.S. patent application Ser. No. 09/631,876, to provide the required amount of clearance between the frame side members 350 and 352 to permit the rockers 312, 314 and pliers jaws 308, 310 to move between the deployed and folded positions of the pliers jaws 308, 310 but without excessive side clearance, and similarly to provide only the desired amount of side clearance for the base of each folding tool blade or bit 322, 324, etc., in one of the side slots 334, 336 between a handle scale 362 and the adjacent frame side member 350 or 352.

Figure 29:
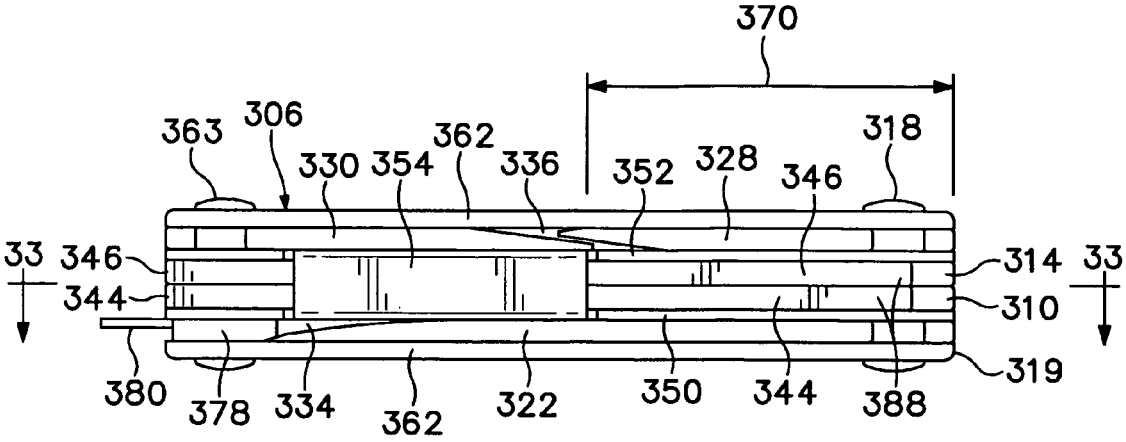
FIG. 29 is a top plan view of the tool shown in FIG. 28.
Figure 30:
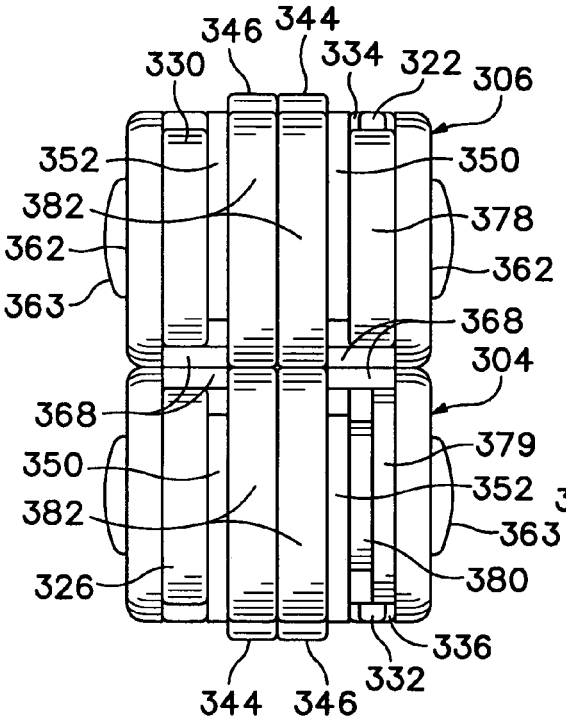
FIG. 30 is an end elevational view of the tool shown in FIG. 28, taken from the end opposite that where the folding pliers jaws are attached to the handles.
Figure 31:
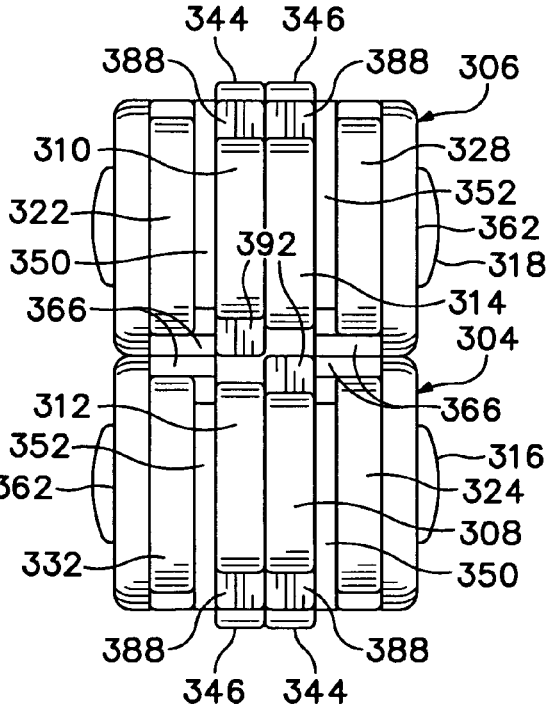
FIG. 31 is an end view of the folding tool shown in FIG. 28, taken from the end at which the folding pliers jaws are attached to the handles.
Figure 33:
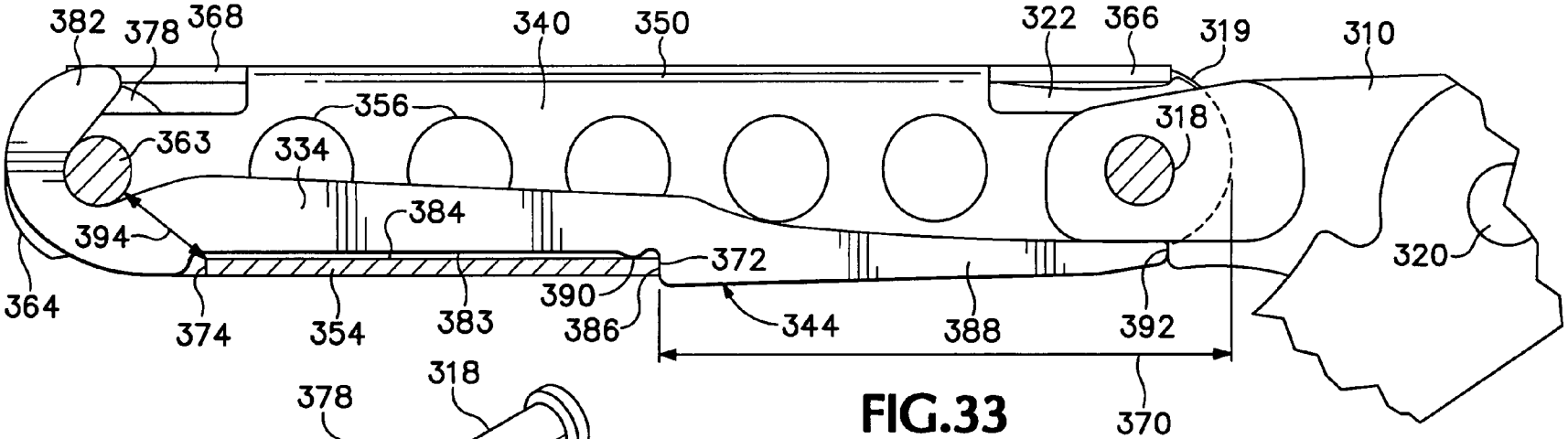
FIG. 33 is a sectional view of the handle shown in FIG. 32, taken along line 33—33 in FIG. 29 at an enlarged scale, and showing a portion of a pliers jaw in its extended position.

Referring now to FIGS. 29 and 33, the center flange 354 interconnecting the frame side members 350 and 352 to form the central channel 340 is located a distance 370 away from the first end 319, where the pliers jaws are connected with the frame. The center flange 354 has a first end face 372 facing toward the first end 319 of the handle. A second end 374 of the center flange 354 is located closer the second end 364 of the handle, so that most of the center flange 354 is located between the middle of the length and the second end 364 of the handle 306, leaving an open space between the frame side members 350 and 352 near the first end 319 of the handle 306.

As shown in FIGS. 26–33 a respective second pivot axle 363 extends transversely through each of the handles 304, 306, interconnecting the outer side plates 362 to the frame and extending between the frame side members 350, 352 at the second end 364 of the handle. In the handle 306 the awl 330 is mounted pivotally near one end of the pivot axle 363, in the side slot 336, while a spacer 378 is near the other end of the second pivot axle 363 in the side slot 334. A central part of the second pivot axle 363 thus extends through an opening defined in one frame side member 350 and another opening defined in the other frame side member 352 at the second end 364 of the handle. In the handle 304 a spacer 379 is located on the second pivot axle 363, together with the lanyard link 380, in the side slot 336.

Figure 32:
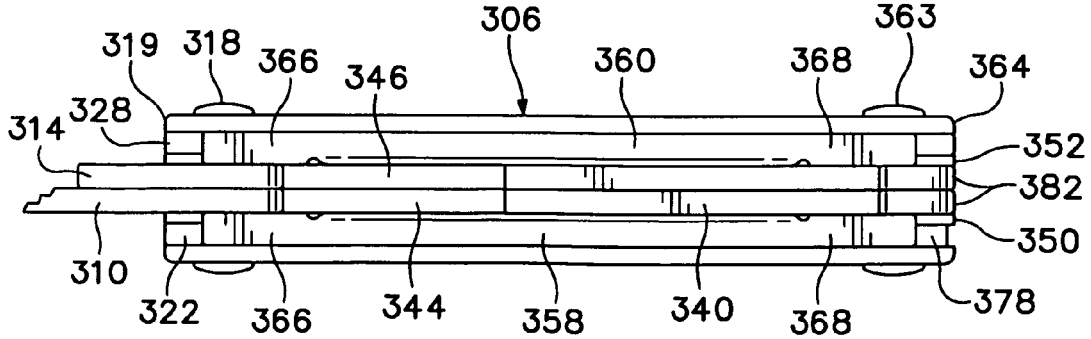
FIG. 32 is a view of one of the handles of the tool shown in FIG. 26, taken in the direction indicated by line 32—32 in FIG. 26.

As shown in FIGS. 32 and 33, each of the beam springs 344, 346 includes a hook portion 382 at one end. The hook portion 382 of each extends around the central part of the second pivot axle 363, and the pivot axle 363 thus functions as a spring retainer to limit movement of the springs 344 and 346 relative to the second end 364 of each handle. A different member projecting from either or both of the handle frame side members 350, 352 toward the other could also serve instead of the pivot axle 363 as such a spring retainer. For example, a part of one or each of the frame side members 350, 352 could be forged, bent, or otherwise made to project toward the other frame side member at the second end 364 of the handle, to serve as a spring retainer about which the hook portion 382 of either spring could extend. Thus, while in the multipurpose folding tool 300 as shown the hook portion 382 of each spring fits snugly about a cylindrical pivot axle 363, the hook portion 382 could have a different interior shape to accommodate a different type of spring retainer associated with the frame side members.

A back surface 383 of the middle portion of the length of each spring 344 or 346 extends along an inner side 384 of the center flange. An abutment shoulder 386 is provided on each spring 344, 346 and fits closely adjacent the first end face 372 of the center flange 354, preventing the spring 344 or 346 from moving longitudinally away from the first end 319 of the handle. The peripheral surfaces of the base of the pliers jaw 310 and of the rocker 314 are pressed by an inner surface of the tip portion 388 of the associated spring 344 or 346 and thus prevent the springs from moving away from the center flange 354 far enough for the abutment shoulder 386 to become disengaged from the first end face 372 of the flange.

Figure 28:
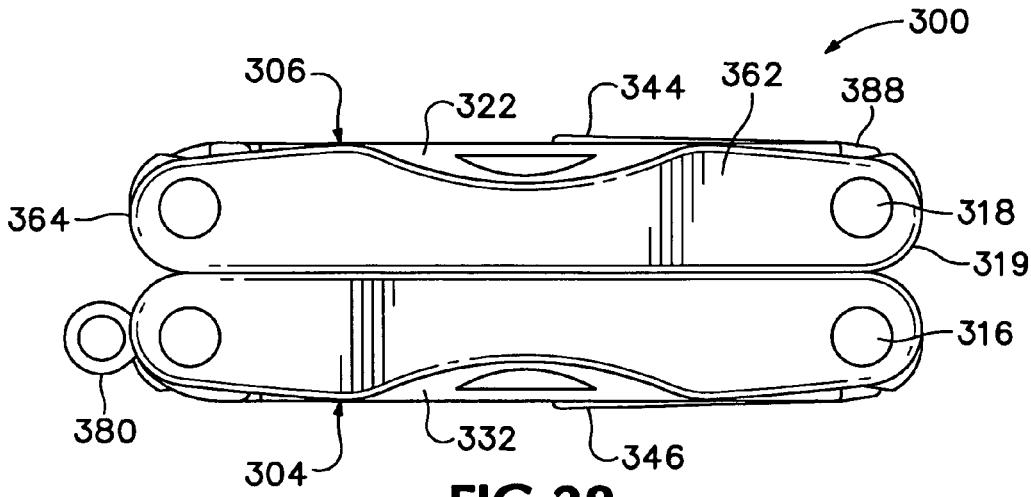
FIG. 28 is a side elevational view of the tool shown in FIG. 27, with all of the blades and the pliers jaws folded.

The springs 344, 346 are thus kept in the required positions with respect to the handle frame cooperatively by the pivot axle 363, acting as a spring retainer on the hook portion 382 of the spring, and by the peripheral surfaces of the base of the pliers jaw 308 or 310 or of the rocker 312 or 314 in contact with the tip portion 388 of each spring, while the middle portion of each spring 344 or 346 is supported by the center flange member 354, and the end face 372 acts on the abutment shoulder 386. As a result, no fasteners are required to hold the springs 344 and 346 in place, so the springs need not be large enough to accommodate a fastener hole extending through the spring as in a conventional folding knife. The tip portions 388 extend over a great enough part of the length of the handle to have ample flexibility and space to flex in handles 304 short enough to provide a very compact size when the tool 300 is folded as shown in FIG. 28.

As with the folding multipurpose tool 30 described above and shown in FIGS. 1–16, the springs 344, 346 can easily be installed in the central channel 340 or 342 defined by the respective handle frame, where they align themselves and are securely retained within the frame without having to be pinned or riveted to the frame side members as in conventional folding knife construction.

As shown best in FIG. 33, a small hump 390 protrudes slightly from the back of each spring 344 and 346 near the abutment shoulder 386, serving as a fulcrum so that the springs can pivot as levers about the hump 390. The pivot axle 363 or other spring retainer at the second end 364 of the handle holds each spring 344 or 346 with ample mechanical advantage about the hump 390 with respect to the tip portion 388, which, being relatively slender, can flex to accommodate the cam shapes of the base of the pliers jaw 310 and of the rocker 314 as the pliers jaw is moved with respect to the handle 306 between its folded position and its deployed position.

The base of each pliers jaw 308 and 310 includes a shoulder including an abutment face 392 that presses against the end face of the tip portion 388 of the springs 344 when the pliers jaws 308, 310 are in their extended, or deployed, positions with respect to the handles 304, 306. When the handles 304, 306 are urged toward each other to close the jaws 308, 310 of the pliers on an object being gripped the abutment face 392 exerts compressive force on the tip portion 388 of the spring in a longitudinal direction toward the first end face 372 of the center flange 354, so that the tip portion 388 of the spring 344 carries most, if not all, of that compressive force to the first end face 372 of the center flange and thus to the side members of the handle frame.

Figure 34:
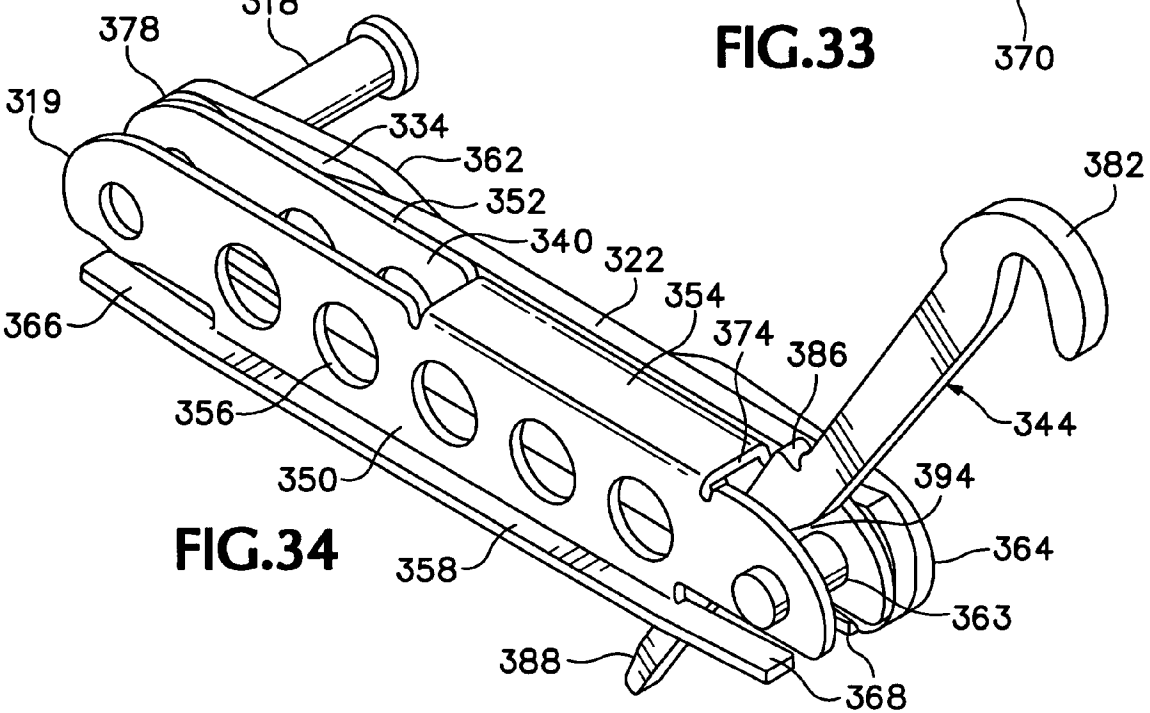
FIG. 34 is an isometric view showing a partially assembled handle such as that shown in FIG. 32, showing a first step of one manner of inserting the springs into the partially assembled handle.
Figure 35:
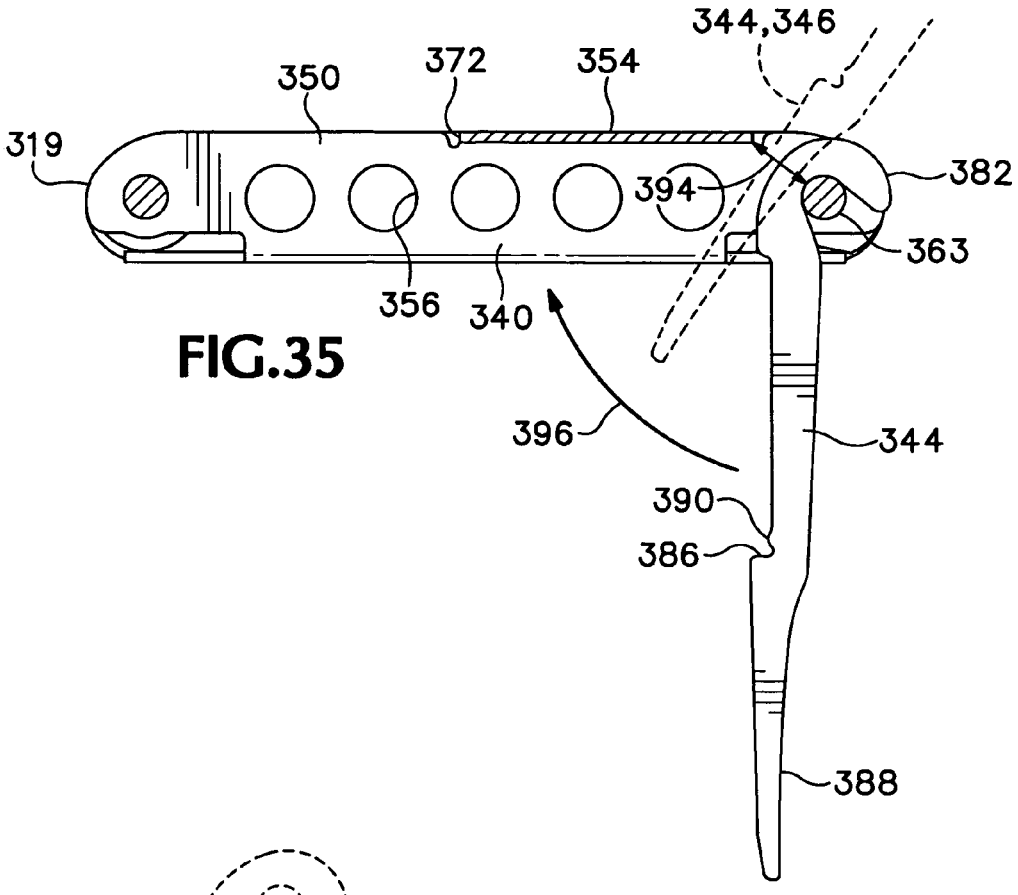
FIG. 35 is a side elevational view of the handle and springs shown in FIG. 34, showing a further step of assembly.

As may be seen with reference also to FIGS. 34 and 35, in one preferred embodiment of the folding multipurpose tool 300, the distance 394 between the second end 374 of the center flange 354 and the pivot axle 363 or other spring retainer at the second end 364 of each handle is great enough to leave room for the main beam springs 344, 346 to be inserted between the flange 354 and the pivot axle 363 or other spring retainer. With the hook portion 382 of a spring 344 or 346 extending around the pivot axle 363 or other spring retainer at the second end 364 of the handle the spring can simply be swung as indicated by the arrow 396 into a position adjacent the center flange 354 in which the abutment shoulder 386 rests on the first end face 372 of the center flange 354.

Preferably, a pivot joint between a pair of pliers jaws 308 and 310 is prepared before attaching the jaws to respective handles. With both of the springs 344, 346 in place, the pliers jaw 308 or 310 and a rocker 312 or 314 can be positioned between the frame side members 350, 352 at the first end 319 of the handle 304 or 306, using enough pressure to deflect the tip portions 388 of the springs so that the pivot axle 316 or 318 can be installed through the corresponding openings in the frame side members 350, 352 at the first end 319 of the handle. When the pivot axles 363, 316 and 318 have been inserted through the remaining tool blades and handle plates 362 they are riveted or otherwise adjusted as mentioned above to complete assembly.

Figure 36:
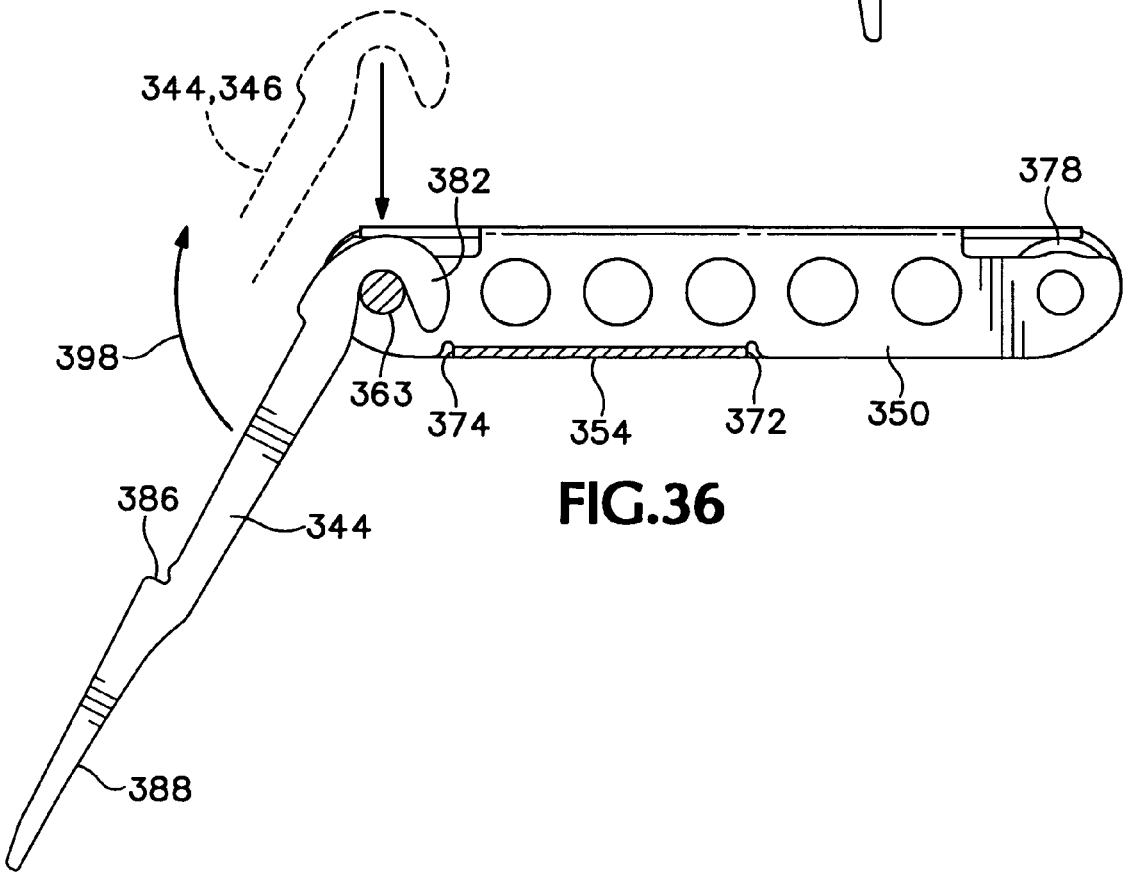
FIG. 36 is a sectional view similar to FIG. 33 showing one step of an alternative method of assembling the pliers jaw and rocker springs into the handle.
Figure 37:
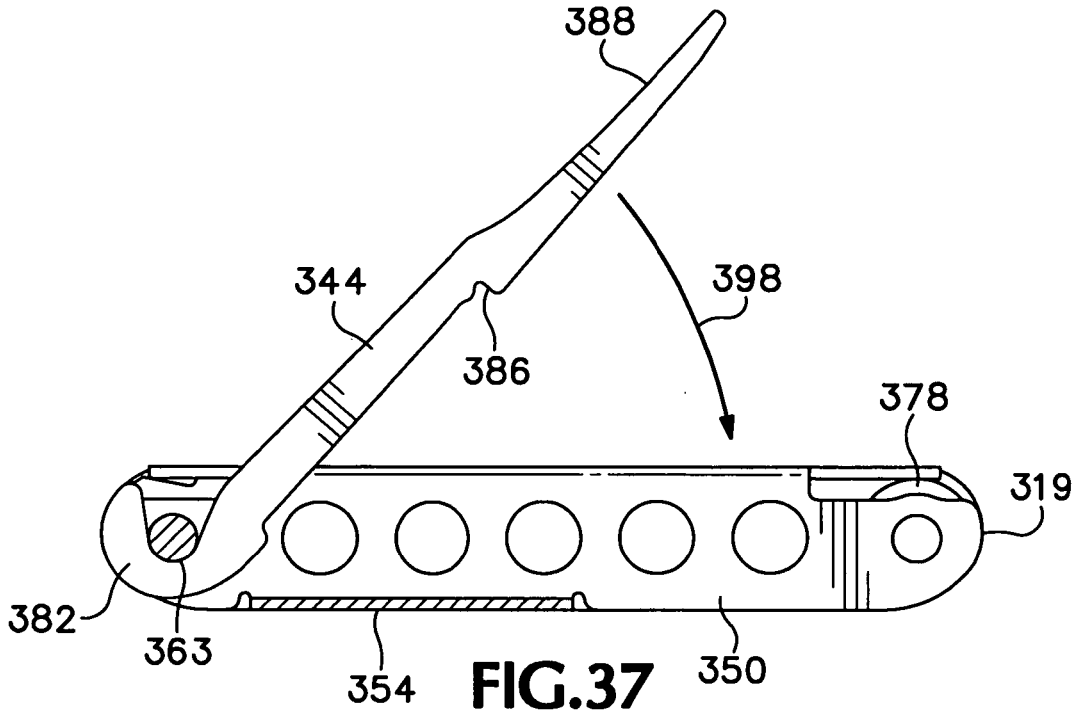
FIG. 37 is a view similar to FIG. 36, showing a further step in the process of assembling the pliers jaw and rocker springs into the remainder of the handle.

Alternatively, with the handle 304 or 306 oriented so that the central channel 340 between the frame side members 350, 352 is in an upwardly open orientation, the hook portions 382 of the springs 344, 346 may simply be placed on the pivot axle 363 or other spring retainer as shown in FIG. 36. The springs may thereafter be swung around in the direction indicated by the arrows 398 in FIGS. 36 and 37 to the required position with the abutment shoulder 386 or each spring engaging the first end face 372 of the flange 354 as shown in FIG. 33, after which installation of blades or tool bits, jaws and rockers is completed as described above.

Figure 38:
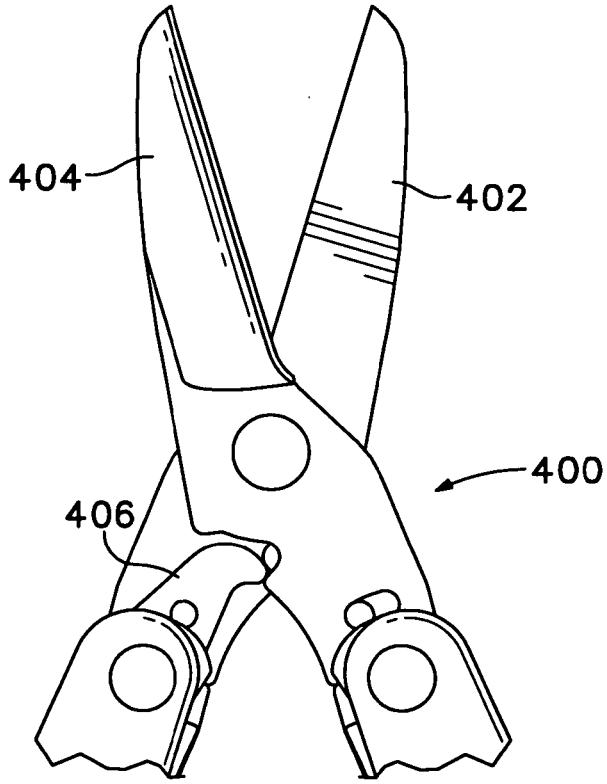
FIG. 38 is a side elevational view of a folding tool similar to that shown in FIGS. 26–33 but including a pair of scissors blades instead of pliers jaws.

As shown in FIG. 38, a multipurpose folding tool 400 similar to the multipurpose folding tool 300 in many respects may include scissors blades 402, 404 instead of the pliers jaws 308, 310, either aided by rockers 406 or mounted in the handles 304, 306 without rockers.

It will also be appreciated that a folding tool including a pair of folding pliers 302 or folding scissors may include handles with frame side members 350, 352 and beam springs 344, 346 supported in central channels 340 of a pair of handles constructed as explained above, but without side slots for additional tool blades or bits, by omitting the side flanges 358, 360 described above from the frame side members.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A subassembly for a folding tool, comprising:

(a) a first frame side member having a pair of opposite ends and having a laterally-extending support member attached thereto between said opposite ends and extending from said first frame side member on a first side thereof;

(b) a pivot axle, extending laterally from said first frame side member on said first side thereof, proximate a first one of said opposite ends thereof;

(c) a spring-supporting element, located adjacent said first frame side member on said first side thereof, at a second one of said opposite ends thereof;

(d) a first tool member having a base portion mounted on said pivot axle for pivoting movement between first and second positions with respect to said frame side member; and (e) a first elongate beam spring having a pair of longitudinally opposite end portions and a central portion, said central portion being engaged with and supported by said laterally-extending support member, a first one of said opposite end portions of said spring resting on said base portion of said first tool member, and the other one of said opposite end portions of said spring resting on said spring-supporting element.

2. The subassembly of claim 1 wherein said laterally-extending support member has an inner side and a pair of opposite end faces, wherein said central portion of said spring includes a back side resting on said inner side of said laterally-extending support member and a pair of abutment shoulders each located adjacent and facing toward a respective one of said end faces of said laterally-extending support member, said end faces of said laterally-extending support member and said abutment shoulders of said spring cooperatively restricting longitudinal movement of said spring with respect to said laterally-extending support member.

3. The subassembly of claim 2, further comprising a second said elongate beam spring located alongside said first spring and a second tool member having a respective base portion mounted on said pivot axle alongside said first tool member, and wherein said second spring includes a central portion having a back side resting on said inner side of said laterally-extending support member and a pair of abutment shoulders each adjacent and facing toward a respective one of said end faces of said laterally-extending support member, and wherein said first tool member is a pliers jaw having a base and a respective first end portion of each of said elongate beam springs presses on said base of said pliers jaw at said first end of said frame side member.

4. The subassembly of claim 1, said handle including a second frame side member having a pair of opposite ends and located a distance apart from said first frame member, said pivot axle extending through said first and second frame side members.

5. The subassembly of claim 1 wherein said opposite end portions of said first elongate beam spring are elastically biased to press, respectively, against said base portion of said first tool member and against said spring-supporting element.

6. The subassembly of claim 1, wherein said spring-supporting element is a base portion of a second tool member mounted on and movable pivotally about a second pivot axle.

7. The subassembly of claim 1 including a retainer located on said pivot axle and alongside said spring and said first tool member, on a side thereof opposite said frame side member, said retainer preventing said first spring and said first tool member from moving laterally out of engagement with each other.

8. The subassembly of claim 1, said handle including a second said frame side member connected to said laterally-extending support member and spaced apart from said first frame side member, said first and second frame side members and said laterally-extending support member thereby forming a channel shorter than each of said frame side members and located between said opposite ends of said frame side members.

9. The subassembly of claim 8, said channel being wide enough to receive said first spring and said first tool member between said first and second frame side members and being narrow enough to keep said first one of said end portions of said first spring aligned with said base portion of said first tool member.

10. The subassembly of claim 8, further comprising a second said elongate beam spring located alongside said first spring and a second tool member having a base portion mounted on said pivot axle proximate said first tool member, said channel being wide enough to receive both of said first and second springs and said first and second tool members between said frame side members and being narrow enough to keep said first end portions of said first and second springs aligned respectively with said base portions of said first and second tool members.

11. The subassembly of claim 8 further comprising a third said frame side member spaced apart from said first frame side member on a side thereof opposite from said second frame side member, said third frame side member having a said laterally-extending support member attached thereto and extending toward said first frame side member, said first frame side member and said third frame side member and said laterally-extending support member attached to said third frame side member defining a second channel.

12. The subassembly of claim 11, wherein said channel and said second channel face openly in opposite directions.

13. The subassembly of claim 1 wherein said first tool member is one of a pair of jawlike members.

14. The subassembly of claim 1, said handle including a second frame side member having a pair of opposite ends and a laterally-extending support member attached thereto and extending laterally therefrom, said pivot axle extending through said second frame side member at said first one of said opposite ends thereof, said subassembly also including a second tool member located adjacent said second frame side member and including a respective base portion mounted on said pivot axle for pivoting movement thereabout between respective first and second positions with respect to said second frame side member, said subassembly further including a second elongate beam spring associated with said second frame side member and said second tool member.

15. The subassembly of claim 14 further comprising a third said frame side member spaced apart from said first frame side member on a side thereof opposite from said second frame side member, said third frame side member having a said laterally-extending support member attached thereto and extending toward said first frame side member, said first frame side member and said third frame side member and said laterally-extending support member attached to said third frame side member defining a second channel.

16. The subassembly of claim 14 wherein said pivot axle and said spring-supporting member define a plane, wherein said laterally-extending support member of said first frame side member and said laterally-extending support member of said second frame side member are located respectively on opposite sides of said plane, and wherein said first tool member moves away from said plane on a first side thereof when moving from said first position to said second position thereof, and wherein said second tool member moves away from said plane on an opposite side thereof when moving from said first position to said second position thereof.

17. The subassembly of claim 1, said handle including a second said frame side member having a respective laterally-extending support member attached thereto, said laterally-extending support members attached to said frame side members being aligned with and extending toward each other, and said pivot axle extending through both of said frame side members at said first one of said opposite ends of each, said pivot axle holding said two frame side members together parallel with each other and spaced apart from each other, said frame side members and said laterally-extending support members attached thereto thereby forming a channel shorter than each of said frame side members and located between said opposite ends of said frame side members.

18. The subassembly of claim 1 wherein three separate tool members are located on said pivot axle adjacent one another and said first frame side member, each of said tool members having a back defining a respective nail nick, the nail nicks of said three separate tool members being located different respective distances from said pivot axle, said distances differing from each other by at least about 2 mm.

19. A subassembly for a folding tool, comprising:

(a) a first frame side member having a pair of opposite ends defining a longitudinal axis of said frame side member;

(b) a pivot axle extending laterally from said first frame side member at a first one of said opposite ends thereof;

(c) a first tool member having a base portion mounted on said pivot axle and movable about said pivot axle between a deployed position and a folded position with respect to said first frame side member;

(d) a spring support connected with said first frame side member between said opposite ends and extending laterally from said first frame side member;

(e) a spring retainer extending laterally from said first frame side member at the other one of said pair of opposite ends of said first frame side member; and (f) an elongate beam spring separate from said first frame side member and having a pair of opposite first and second end portions and a middle portion, said middle portion being supported by said spring support and including a shoulder portion engaged with a first end of said spring support, thereby limiting movement of said spring away from said pivot axle in a longitudinal direction with respect to said first frame side member, said first end portion of said spring resting on said base portion of said first tool member, and said opposite second end portion of said spring including an engagement member engaged with said spring retainer.

20. The subassembly of claim 19 wherein said first tool member includes an abutment face and said first end portion of said spring includes a tip that engages said abutment face and supports said tool member in said deployed position.

21. The subassembly of claim 19 wherein said spring support has a second end facing toward and located near said second one of said opposite ends of said first frame side member yet spaced far enough from said spring retainer to permit said spring to be inserted between said second end of said spring support and said spring retainer and thus to permit said engagement member to be placed into engagement with said spring retainer and to permit said shoulder to be placed into engagement with said first end of said spring support during installation of said spring into an operative position with respect to said frame side member.

22. The subassembly of claim 19, including a second frame side member parallel with said first frame side member, said spring support extending from said first frame side member to said second frame side member.

23. The subassembly of claim 22 wherein first and second frame side members and said spring support define a central channel, and said spring is located within said central channel.

24. The subassembly of claim 23 wherein said central channel and said spring cooperatively define a storage cavity for said first tool member.

25. The subassembly of claim 19 wherein said first tool member is a first one of a pair of pliers jaws, and a second one of said pair of pliers jaws is included in a second said subassembly.

26. The subassembly of claim 19 wherein said first tool member is a first blade of a pair of scissors, and a second blade of said pair of scissors is included in a second said subassembly.

27. The subassembly of claim 19 wherein said beam spring includes a hump that rests on said spring support as a fulcrum about which said beam spring can flex.

28. A subassembly for a folding tool, comprising:

(a) a first frame side member having a pair of opposite ends;

(b) a pivot axle, extending laterally from said first frame side member at a respective one of said opposite ends thereof;

(c) a projecting member extending laterally from said first frame side member at the other one of said opposite ends thereof;

(d) a tool bit having a base attached to said first frame side member by a pivot pin spaced apart from and located generally between said pivot axle and said projecting member, said tool bit being movable about said pivot pin between two positions, and said base of said tool bit having a pair of engagement surfaces each corresponding to one of said two positions; and (e) a spring having a pair of opposite ends, a first one of said pair of opposite ends being mounted on said pivot axle, and the other one of said pair of opposite ends being mounted on said projecting member, and said spring including a central portion aligned with and biased into contact with said base of said tool bit, said central portion of said spring being spaced apart from said flange and having clearance to move toward said flange, and said spring tending to hold said tool bit in a respective one of said two positions when said spring is in contact with a respective one of said pair of engagement surfaces.

29. A folding tool, comprising;

(a) a first frame side member having a pair of opposite ends;

(b) a pair of supports, each one of said pair extending laterally from said first frame side member at a respective one of said opposite ends thereof;

(c) a first tool member having a base attached to said first frame side member by a pivot pin spaced apart from and located between said opposite ends of said first frame side member, said first tool member being movable about said pivot pin between two positions; and (d) a spring having a pair of longitudinally opposite ends each mounted on a respective one of said pair of supports and having a central portion in contact with said base of said first tool member, said central portion of said spring having clearance to move in response to movement of said base of said first tool member, and said spring urging said tool member toward one of said two positions.

30. The folding tool of claim 29, including a retainer located on one of said supports alongside said spring on a side thereof facing away from opposite said first frame side member, said retainer keeping said spring from moving laterally away from said first frame side member.

31. The folding tool of claim 29 wherein said base of said first tool member has a respective engagement surface corresponding to each of said two positions and said central portion of said spring is in contact with a respective one of said engagement surfaces when said first tool member is in either one of said two positions.

32. A subassembly for a folding tool, comprising:

(a) a first frame side member having a pair of opposite ends;

(b) a pair of parallel pivot axles, each one of said pair being located at a respective one of said opposite ends of said first frame side member;

(c) a first tool member having a base attached to said first frame side member by a pivot pin located between said opposite ends, said first tool member being movable about said pivot pin between two positions with respect to said frame side member, and said base of said first tool member having a pair of engagement surfaces each corresponding to one of said two positions; and (d) a first spring having a pair of opposite ends each mounted on a respective one of said pair of pivot axles and a central portion aligned with and biased into contact with said base of said first tool member, and said spring tending to hold said tool bit in a respective one of said two positions when said spring is in contact with a respective one of said pair of engagement surfaces.

33. A subassembly according to claim 32, said first frame side member having an integral flange member located between said opposite ends and extending laterally therefrom and said central portion of said spring being spaced apart from said flange and having clearance to move toward said flange, said subassembly including a second spring adjacent said first spring, said second spring having a pair of opposite free ends and resting against said flange member intermediate said opposite ends of said first frame side member.

34. A subassembly according to claim 33, including a second tool member having a base pivotably mounted on one of said pivot axles, one of said ends of said second spring resting against said base of said second tool member.

35. A subassembly according to claim 32, including a retainer located on one of said pivot axles alongside said first spring and said first tool member on a side thereof opposite said first frame side member, said retainer preventing said first spring and said first tool member from moving laterally out of engagement with each other.

36. A subassembly according to claim 35 wherein said retainer is a second spring.

37. A subassembly according to claim 35 wherein said retainer is a second frame side member.

* * * * *